US010684108B2

(12) United States Patent
Peterson et al.

(10) Patent No.: US 10,684,108 B2
(45) Date of Patent: Jun. 16, 2020

(54) REDUCED DRAG PROJECTILES

(71) Applicant: Vista Outdoor Operations LLC, Farimington, UT (US)

(72) Inventors: Bryan P. Peterson, Isanti, MN (US); Richard Hurt, Clearlake, MN (US); David M. Laska, Andover, MN (US); Drew L. Goodlin, Isanti, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/012,444

(22) Filed: Jun. 19, 2018

(65) Prior Publication Data

US 2018/0364017 A1 Dec. 20, 2018

Related U.S. Application Data

(63) Continuation-in-part of application No. 15/331,631, filed on Oct. 21, 2016, now Pat. No. 10,001,355.

(60) Provisional application No. 62/244,588, filed on Oct. 21, 2015.

(51) Int. Cl.
*F42B 14/02* (2006.01)
*F42B 5/02* (2006.01)

(52) U.S. Cl.
CPC ..... *F42B 14/02* (2013.01); *F42B 5/025* (2013.01)

(58) Field of Classification Search
CPC ..... F42B 14/02; F42B 5/025
USPC ..... 102/439
See application file for complete search history.

(56) References Cited

U.S. PATENT DOCUMENTS

| | | | | | |
|---|---|---|---|---|---|
| RE4,491 | E | * | 8/1871 | Berdan | 102/439 |
| 375,158 | A | | 12/1887 | Hill | |
| 535,101 | A | | 3/1895 | Godfrey et al. | |
| 694,675 | A | * | 3/1902 | Scott | F42B 5/02 102/436 |
| 1,080,974 | A | | 12/1913 | Johnson | |
| 1,135,357 | A | | 4/1915 | Clyne | |
| 1,328,334 | A | | 1/1920 | Newton | |
| 1,493,614 | A | | 5/1924 | Dickerman | |
| 1,944,885 | A | * | 1/1934 | Gerlich | F41A 21/16 102/514 |
| 1,967,416 | A | | 7/1934 | Leussler | |
| 2,696,130 | A | | 12/1954 | Peters | |
| 2,911,911 | A | * | 11/1959 | White | F42B 14/02 102/439 |
| 2,928,348 | A | | 3/1960 | Zisman et al. | |

(Continued)

FOREIGN PATENT DOCUMENTS

| | | |
|---|---|---|
| GB | 190622505 A | 5/1907 |
| RU | 2413169 C1 | 2/2011 |
| WO | WO 01/18483 | 3/2001 |

*Primary Examiner* — Samir Abdosh
(74) *Attorney, Agent, or Firm* — Reed Smith LLP; Matthew P. Frederick; Cheryl L. Gastineau

(57) ABSTRACT

A cartridge comprising an elongate rifle bullet with a plurality of circumferential grooves having overmolded polymer therein defining embedded polymer rings. The cartridge further having a case and propellant. The polymer rings have an outer surface that is flush with, that is, conforming to the outer surface of the body. The polymer may have be selected to have a favorable coefficient of friction with respect to the barrel. The bands offering reduction of the metal to metal contact between the bullet and the barrel while not diminishing the ballistic coefficient of the bullet.

16 Claims, 26 Drawing Sheets

(56) References Cited

U.S. PATENT DOCUMENTS 3,786,760 A * 1/1974 Feldmann ..... F42B 14/02 102/527
3,838,497 A * 10/1974 Rizzitano ..... B23K 1/18 228/212
3,881,421 A 5/1975 Burczynski
4,044,685 A 8/1977 Avcin
4,108,074 A * 8/1978 Billing, Jr. ..... F42B 8/14 102/529
4,245,557 A 1/1981 Knappworst et al.
4,519,117 A * 5/1985 Gotz ..... F42B 14/02 86/55
4,520,731 A * 6/1985 Gotz ..... F42B 14/02 102/527
4,655,140 A 4/1987 Schirneker
4,685,397 A 8/1987 Schirneker
4,754,708 A * 7/1988 Garrett ..... F42B 14/02 102/527
5,127,332 A 7/1992 Corzine et al.
5,259,320 A 11/1993 Brooks
5,454,325 A 10/1995 LeBlanc
6,070,532 A 6/2000 Halverson
6,317,946 B1 11/2001 Beal
6,526,893 B2 3/2003 May et al.
6,546,875 B2 4/2003 Vaughn et al.
7,380,502 B2 6/2008 Emary
7,503,521 B2 * 3/2009 Maynard ..... F41G 3/18 102/501
7,748,325 B2 * 7/2010 Marx ..... F42B 12/34 102/501
7,900,561 B2 3/2011 Marx
8,186,277 B1 5/2012 King
8,286,558 B2 10/2012 Marx
8,393,273 B2 3/2013 Weeks et al.
8,474,380 B2 * 7/2013 Harrison ..... F42B 30/02 102/380
8,752,484 B2 6/2014 Burczynski
D733,252 S * 6/2015 Burczynski ..... D22/115
9,366,512 B2 6/2016 Burczynski et al.
9,494,397 B2 11/2016 Carlson et al.
9,797,695 B2 * 10/2017 Gelfert ..... F42B 5/067
2006/0230971 A1 * 10/2006 Harrison ..... F42B 5/10 102/374
2007/0289475 A1 12/2007 Kapeles
2010/0078844 A1 4/2010 Kapeles
2012/0180687 A1 7/2012 Padgett et al.
2013/0025490 A1 1/2013 Burczynski
2014/0311372 A1 * 10/2014 Burczynski ..... F42B 14/00 102/508
2014/0331885 A1 * 11/2014 Burczynski ..... F42B 5/02 102/439
2016/0252332 A1 * 9/2016 Gelfert ..... F42B 5/067 102/464

* cited by examiner

REDUCED DRAG PROJECTILES

This application is a continuation-in-part of U.S. Utility patent application Ser. No. 15/331,631, filed on Oct. 21, 2016, now U.S. patent Ser. No. 10/001,355. Said patent claims priority to U.S. Provisional Application No. 62/244,588 filed on Oct. 21, 2015. The above applications and patent are incorporated by reference herein.

FIELD

The present disclosure relates to low caliber firearm bullets, that is, .50 caliber and less, and more specifically, to cartridges and rifle bullets.

BACKGROUND OF THE DISCLOSURE

Rifle bullets have a conventional elongate shape with pointed tip. The elongate shape adds stability during flight and increases the kinetic energy for a particular bullet size. The elongate shape also increases metal surface area contacting the metal barrel during firing and the metal to metal, barrel to bullet, friction can reduce the muzzle velocity of the bullet. Bullets are known having rearward ends with a boat tail and circumferential grooves, both of which have the effect of reducing the surface area of elongate bullet and the metal to metal engagement and friction. Such grooves in rifle bullets have previously been filled with grease for lubrication between the barrel and bullet. Bullets with grooves filled with grease are not commercially feasible in today's market.

Innovations providing even incremental improved performance of bullets would be welcome in the marketplace. Such improved performance would certainly include increasing the muzzle velocity of a bullet without effecting its ballistic coefficient. Providing such improved performance with minimal increase in manufacturing cost would be very advantageous.

SUMMARY

Adding grooves to a low caliber bullet can result in greater muzzle velocity. Such grooves provide less surface area of metal to metal contact between bullet and rifled barrel and can also reduce the needed energy to deform the bullet surface by the barrel rifling, both of which can provide an increase in muzzle velocity. However, providing such grooves can increase the bullet drag in air. Bullets are designed to have minimal decrease in velocity as they travel down range as quantified by a "ballistic coefficient". The higher the ballistic coefficient the less drag a bullet has traveling down range. It is estimated that each circumferential groove decreases the ballistic coefficient of a rifle bullet by about 3.5%.

Embodiments of the invention include an elongate rifle bullet with a plurality of circumferential grooves having overmolded polymer therein defining embedded polymer rings. Embodiments of the invention include cartridges with propellant and such bullets. In one or more embodiments, the bullet has a body portion and a converging nose portion, the nose and body being monolithic. In one or more embodiments the nose may be hollow and the body solid. The polymer rings have an outer surface that is flush with, that is, conforming to the outer surface of the body with the same or substantially the same radius. A feature and advantage of embodiments is that the metal to metal contact between the bullet and the barrel is reduced while not diminishing the ballistic coefficient of the bullet.

In embodiments the outer surface of the polymer rings may have a slight concavity such that when the bullet is deformed by the rifling of the barrel, the polymer flows to an extent to level the concavity when the bullet exits the muzzle.

The overmolding polymer may be formed of various known polymers such as polyamides, acrylonitrile butadiene styrene (ABS), polyetheretherketone (PEEK), polyetherketone (PEK), polyethylene terephthalate (PET), polyoxymethylene plastic (POM/Acetal), ultra-high-molecular-weight poly-ethylene (UHMWPE/UHMW), various fluoropolymers such as polytetrafluoroethylene (PTFE). The bullet may be heated before the overmolding to increase the adhesion between the polymer and the bullet. The polymer may be chosen to provide a minimal coefficient of friction with respect to the steel barrel.

In one or more embodiments, the bullet may have a polymer tip inserted in a forward interior cavity of the bullet. The polymer may include a main portion forward of the opening and a tip retention portion filling the interior cavity and having a shape corresponding to the interior cavity to retain the polymer tip in place. In some embodiments, the bullet includes a more steeply tapered forward portion that defines a forward facing annular ridge. The tip retention portion may include an exterior portion which encloses the forward portion of the bullet and fills the forward facing annular ridge to retain the polymer tip in place.

Embodiments of the invention provide benefits from a rifle bullet with polymer rings and a polymer tip with improved retention characteristics. A feature and advantage of embodiments is that bands may be adhered by the adhesion created during overmolding as well as by the lock provided by the loop, as well as by a mechanical lock in certain embodiments. For example, the groove may include an undercut on the rearward side of the groove, the forward side of the groove, or both.

Embodiments of the invention are directed to manufacturing bullet by insert-molding bands in circumferential grooves. In one or more embodiments an overmolded tip may also be provided. In one or more embodiments, the bands and tip may be molded in a single operation. In one or more embodiments, the polymer tips may include portions filling external jacket skives reducing external-ballistics drag penalties.

A feature and advantage of one or more embodiments is a projectile that addresses environmental concerns regarding lead by providing a projectile that includes reduced amount of lead or is free of lead.

A feature and advantage of one or more embodiments is a projectile that forms an entrance wound when entering a body (such as the body of a game animal or a block of ballistic gel) and forms an exit wound that is larger than the entrance wound upon exiting the body. The relatively large exit wound may cause greater blood loss leading to a faster kill. The increased blood loss may also create a blood trail useful for tracking a wounded animal.

A feature and advantage of one or more embodiments is a projectile that deforms to an expanded or mushroomed shape while passing through a body (such as the body of a game animal or a block of ballistic gel). In an embodiment, the expanded or mushroomed shape has an overall lateral width and a surface area that is greater than the overall lateral width and the surface are of the undeformed projectile.

A feature and advantage of one or more embodiments is a projectile that forms multiple pedals while passing through a body (such as the body of a game animal or a block of ballistic gel). In an embodiment, the pedals provide enhanced cutting action. In an embodiment, the pedals increase the overall lateral width and the surface area of the projectile compared to the shape of the projectile before the multiple pedals are formed. A feature and advantage of one or more embodiments is a projectile that folds along localized area of weakness to assume a deformed shape.

A projectile in accordance with one or more example embodiments comprises a projectile body, a plurality of polymer bands and a polymer tip member. In one or more embodiments, the projectile body includes a tail portion, a nose portion and a barrel engaging portion extending rearwardly between the nose portion and the tail portion. In one or more embodiments, the portions of the projectile body are arranged along a central longitudinal axis. In one or more embodiments, the tail portion has a rearward facing surface defining an XY plane. In these embodiments, the tail portion extends forwardly along the central longitudinal axis of the projectile body between the rearward facing surface and the barrel engaging portion. In one or more embodiments, the central longitudinal axis is orthogonal to the XY plane. In one or more embodiments, the tail portion has a tail radius extending between the central longitudinal axis and an outer tail surface of the tail portion. In one or more embodiments, the tail radius increases as the tail portion extends forwardly along the central longitudinal axis.

In one or more embodiments, the barrel engaging portion of the projectile body extends forwardly along the central longitudinal axis between the tail portion and the nose portion. The barrel engaging portion has a barrel engaging radius extending between the central longitudinal axis and a barrel engaging surface of the barrel engaging portion. In one or more embodiments, the barrel engaging portion defines a plurality of circumferential grooves. In one or more embodiments, the projectile comprising a plurality of polymer bands with each polymer band being disposed in one of the circumferential grooves defined by the barrel engaging portion.

In one or more embodiments, the nose portion of the projectile body comprising a forward facing edge defining an opening. In one or more embodiments, the nose portion extends forwardly along the central longitudinal axis between the barrel engaging portion and the forward facing edge. In one or more embodiments, the nose portion has a nose radius extending between the central longitudinal axis and an outer nose surface of the nose portion. In one or more embodiments, the nose radius decreases as the nose portion extends forwardly along the central longitudinal axis. In one or more embodiments, the nose portion has a shape generally corresponding to the shape of an ogive.

In one or more embodiments, the projectile body comprises a body wall extending between an interior wall surface and an exterior wall surface. Said body wall constitutes a jacket with respect to core material, such as lead in the cavity defined by the jacket. In one or more embodiments, the interior wall surface defines an interior cavity and the interior cavity fluidly communicates with the opening defined by the forward facing edge of the nose portion. In one or more embodiments, the interior cavity extends rearwardly from the opening to a cavity end point within the projectile body.

In one or more embodiments, core material comprising a core member is disposed inside the interior cavity. In one or more embodiments, the core member comprises a forward facing surface and the core member extends rearward from the forward facing surface to the interior cavity end point within the projectile body. In one or more embodiments, the forward facing surface of the core member and the interior wall surface define a forward portion of the interior cavity. In one or more embodiments, the forward portion of the interior cavity has a cavity radius that decreases as the forward portion of the interior cavity extends forward from the forward facing surface of the core member to the opening.

In one or more embodiments, the projectile includes a tip member extending through the opening. In one or more embodiments, the tip member has a distal portion extending forward of the opening and a proximal portion extending rearward of the opening. In one or more embodiments, the proximal portion of the tip member has a tip retention radius extending between the central longitudinal axis and a tip retention surface of the proximal portion of the tip member. In one or more embodiments, the tip retention radius increases as the proximal portion of the tip member extends rearward from the opening to the forward facing surface of the core member.

In one or more embodiments, a method of manufacturing a bullet comprises obtaining a bullet body defining one or more circumferential grooves; inserting the bullet body in a mold, the mold including one or more groove sprues, wherein, upon insertion of the bullet body into the mold, each groove defined by the bullet body is placed in fluid communication with at least one of the plurality of groove sprues; injecting molten polymer into the grooves through the sprues; allowing the polymer to cool forming a plurality polymer bands, each polymer band being disposed in one of the plurality of circumferential grooves; and removing the bullet body from the mold. In one or more embodiments, a method of manufacturing a bullet comprising obtaining a bullet body defining one or more circumferential grooves, the bullet body comprising a body wall extending between an interior wall surface and an exterior wall surface, the interior wall surface defining an interior cavity, the interior cavity fluidly communicating with an opening defined by a forward facing edge of the bullet body, the interior cavity extending rearwardly from the opening to a cavity end point within the bullet body, a core member disposed inside the cavity, the core member comprising a forward facing surface, the core member extending rearwardly from the forward facing surface to the cavity end point within the body, the forward facing surface of the core member and the interior wall surface defining a forward portion of the interior cavity, the forward portion of the interior cavity having a cavity radius, the cavity radius decreasing as the forward portion of the interior cavity extends forward from the forward facing surface of the core member to the opening. In one or more embodiments, the method further includes inserting the bullet body in a mold with at least one tip sprue and one or more groove sprues, so that each groove sprue is in fluid communication with one of the one or more circumferential grooves and the forward portion of the interior cavity is in fluid communication with the at least one tip sprue; injecting molten polymer into the one or more grooves through the one or more groove sprues; injecting molten polymer into the forward portion of the interior cavity through the at least one tip sprue; allowing the polymer to cool forming a polymer tip and one or more polymer bands, each polymer band being disposed in one of the one or more circumferential grooves, the polymer tip comprising a forward portion extending forward of the opening and a rearward portion extending rearward of the opening, the rearward portion having a shape corresponding to the forward portion of the interior cavity to retain the polymer tip in place; and removing the bullet body from the mold.

A feature and advantage of embodiments is an overmolded polymer band in a cannelure or groove in the ogival portion of a bullet, the cannelure or groove for effecting particular upset characteristics, the polymer band eliminating or reducing what would otherwise be the negative effects of the ogival cannelure or groove.

A feature and advantage of embodiments are overmolded polymer bands in groove in the barrel engaging portion of a projectile body, one or more of the polymer bands, may be raised, projecting radially outward from the exterior surface of the barrel engaging portion. The case may be swaged thereon providing enhanced sealing and waterproofing characteristics of such a cartridge. The exterior surface of the projecting bands may have curvilinear shape.

A feature and embodiment is an overmolded base plug that may secure a core or tracer material therein.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
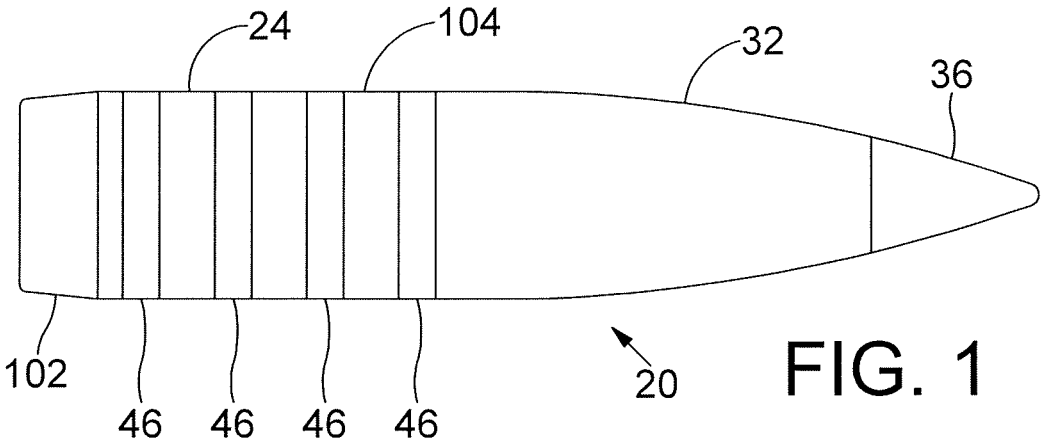
FIG. 1 depicts a side elevation view of rifle bullet, according to one or more embodiments.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
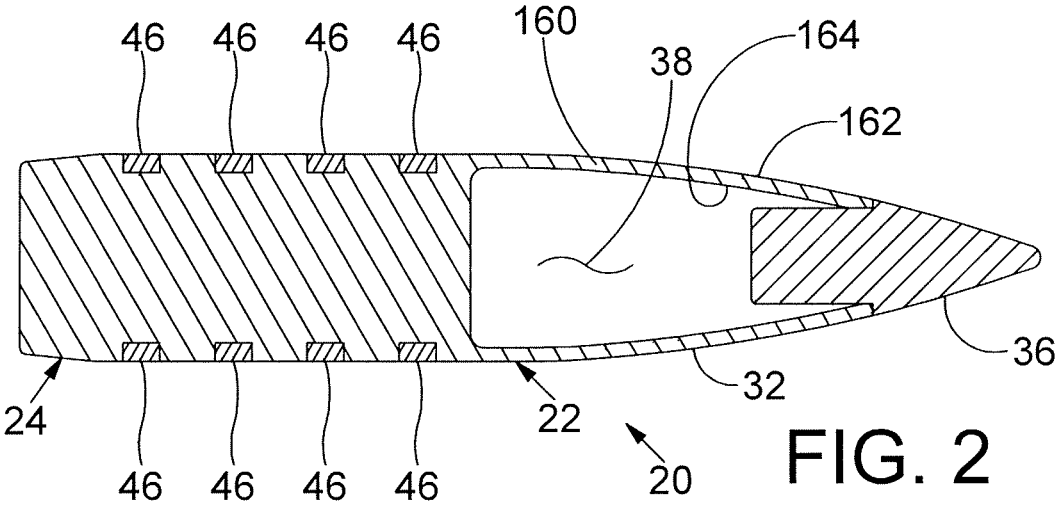
FIG. 2 is a cross-sectional view of the bullet of FIG. 1.
Figure 3:
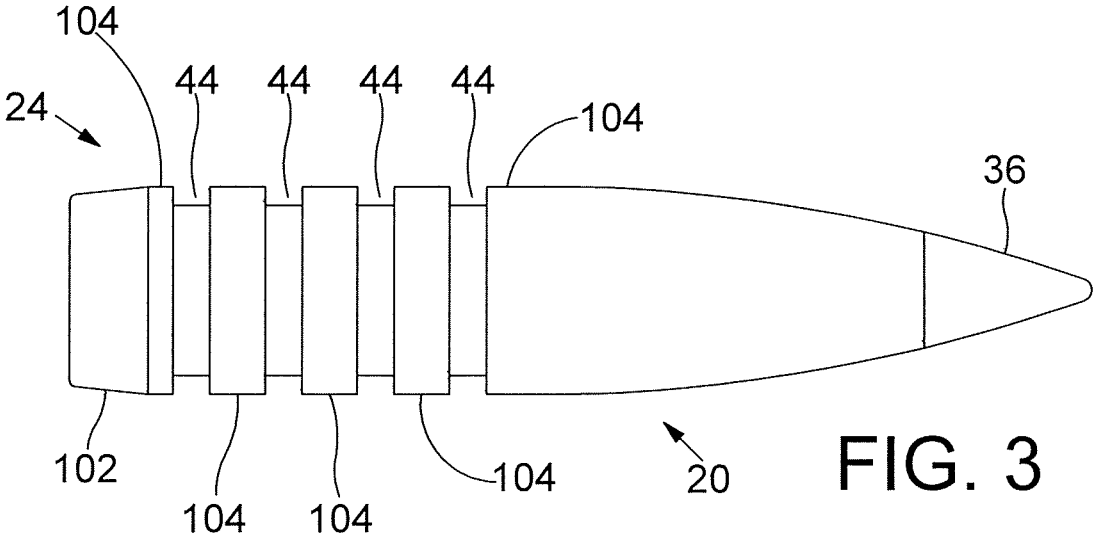
FIG. 3 depicts a side elevation view of the bullet body of FIG. 1 before the overmolding process.

Referring to FIGS. 1-3, a side view of rifle bullet 20 is depicted according to one or more embodiments. The bullet 20 has a body 22 with a main body portion 24 and a nose portion 32. In one or more embodiments, the main body portion 24 comprises a tail portion 102 and a barrel engaging portion 104. Additionally, the bullet 20 may include a polymer tip 36 in a forward cavity 38 of the nose portion 32. The bullet main body portion and nose portion in one or more embodiments are monolithic. In one or more embodiments, the bullet 20 has one or more circumferentially extending grooves 44. The grooves having polymer bands 46 therein formed by overmolding. The grooves may have "square" corners but also other shapes including an undercut shape are within the scope of the invention. That is, the cross section of the groove and the band molded therein may be, by way of example and not limitation, trapezoidal shaped in lateral cross-section and/or a C-shape cut. The grooves are contemplated to extend inwardly 4 to 15% of the diameter of the main body portion adjacent to the groove. In one or more embodiments, there pa be 1, 2, 3, 4, or 5 grooves. In one or more embodiments there may be a single groove. In one or more embodiments a monolithic body portion, tail portion and nose portion are formed of unalloyed copper, a copper alloyed with another metal, or other metal.

Figure 4:
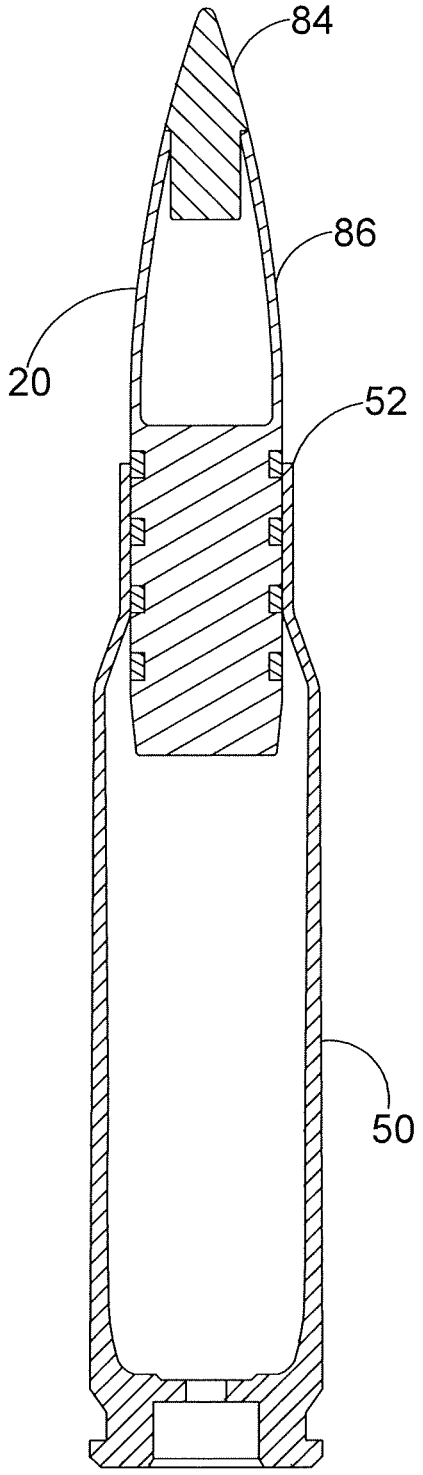
FIG. 4 depicts a cross-sectional illustrating a bullet and casing and the respective interface according to one or more embodiments.

Referring to FIG. 4, a bullet 20 according to embodiments of the invention is seated in a casing 50. An upper lip 52 of the casing 50 may be aligned and slightly swaged inwardly at one of the bands whereby a very secure high integrity seal with respect to the interior of the casing and the propellant may be formed.

Figure 5:
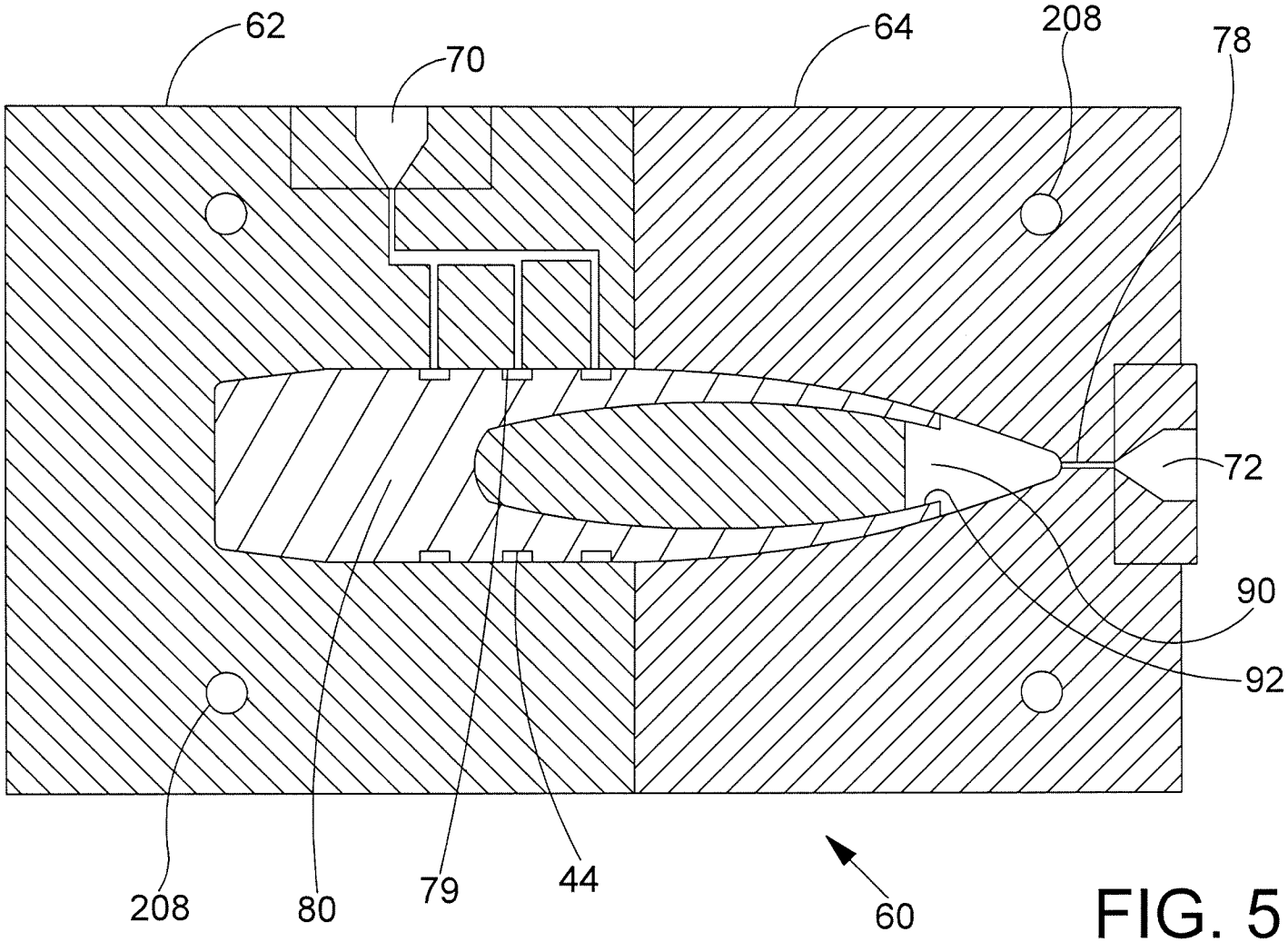
FIG. 5 is a cross-sectional view of mold with a bullet therein prior to overmolding polymer bands thereon.

Referring to FIG. 5, a mold 60 is illustrated with two mold halves 62, 64, and with nozzle ports 70, 72 for injection molding molten polymers, and with sprues 76, 78. The sprues 76 leading to the grooves in the bullet body 80 effect the overmolding of the bands in the grooves. The sprue 78 provide the molten polymer for the overmolded tip. In one or more embodiments, the mold wall surface 79 is flush at the location of the grooves and the adjacent body portions.

As overmolded or inserted, the polymer tip 36 has an exterior surface 84 substantially flush with an exterior surface 86 of the bullet for forming a relatively streamlined or spitzer aerodynamic shape. In one or more embodiments, the front cavity 90 may have an undercut portion 92 for providing a mechanical lock for the tip.

The bullet may be conventionally formed up to the overmolding process. In the overmolding process, the bullet is put in the mold, the mold is closed, and the polymer is injected into the groove and other recess in the bullet that are being overmolded.

Once injected, the mold 60 applies a holding pressure to the bullet body 80 and the injected thermoplastic material to reduce potential air pockets and for completely filling the grooves 44 and/or the tip cavity 90 with thermoplastic material. As pressure is applied, the mold and thermoplastic material begin to cool and the thermoplastic material solidifies. In one or more embodiments, cooling is expedited by convection due to coolant flowing through cooling lines 208 inside the mold 60. The mold is opening and the bullet removed. Sprue pieces may be trimmed from the bullet as needed.

Figure 6A:
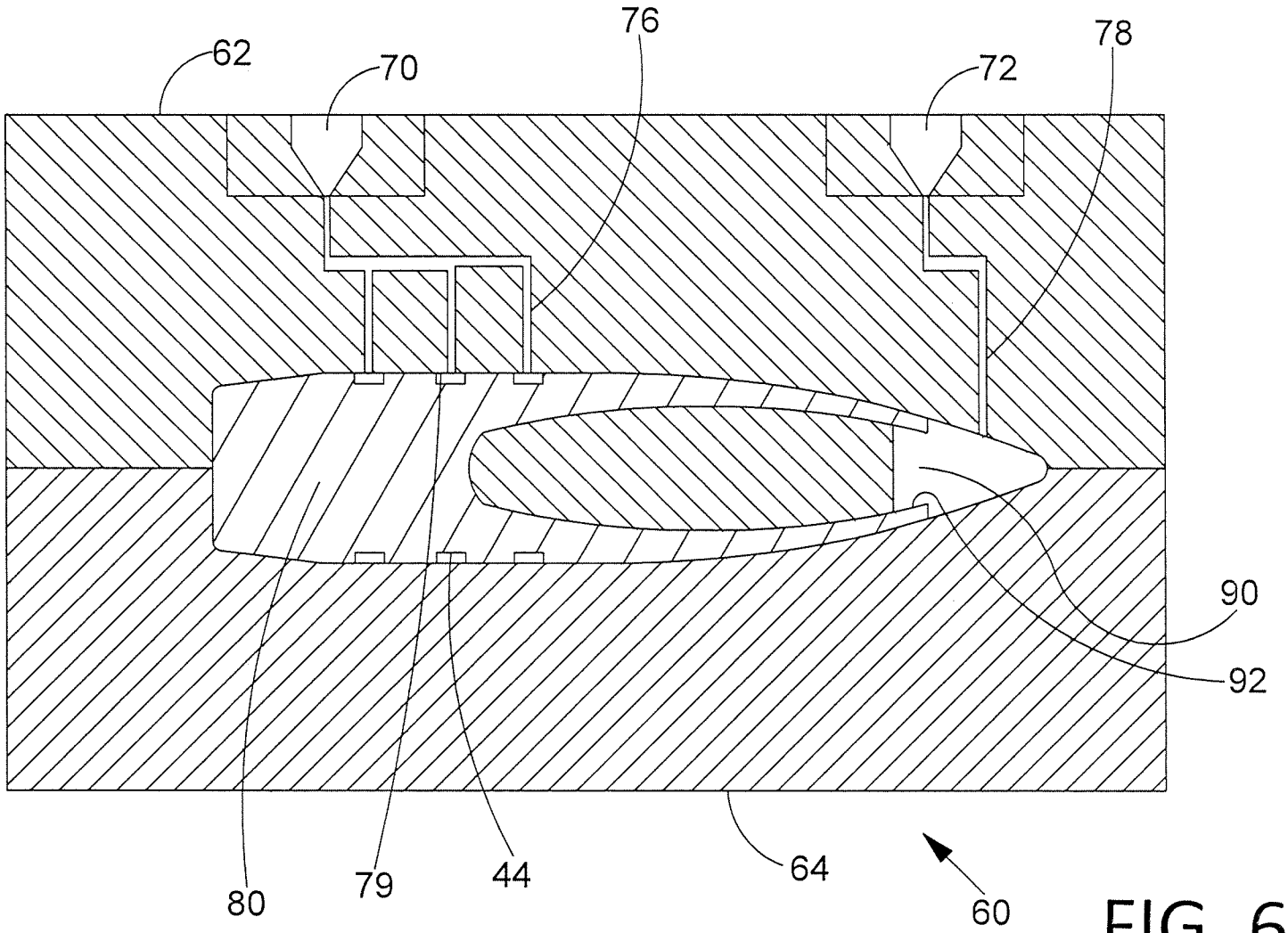
FIG. 6A is a cross-sectional view of mold with a bullet therein prior to overmolding polymer bands and a tip thereon.

Referring to FIG. 6A, a mold 60 comprising two mold halves 62, 64 is shown. The mold 60 also includes two nozzle ports 70, 72 and sprues 76, 78 for injection molding molten polymers. The sprues 76 leading to the grooves in the bullet body 80 effect the overmolding of the bands in the grooves. The sprue 78 provides molten polymer to a tip cavity for forming a polymer tip. In one or more embodiments, the mold wall surface 79 is flush at the location of the grooves and the adjacent body portions. In one or more embodiments, a front cavity 90 defined by the bullet body 80 includes an undercut portion 92 for providing a mechanical lock with the polymer tip. In overmolding processes, in accordance with one or more embodiments, the bullet body 80 is put in the mold, the mold is closed, and the polymer is injected into the groove(s) and other cavities in the bullet that are being overmolded. Once molten thermoplastic material is injected into the mold 60, the mold 60 applies a holding pressure to the bullet body 80 and the injected thermoplastic material to reduce potential air pockets and for completely filling the grooves 44 and/or the tip cavity 90 with thermoplastic material. As pressure is applied, the mold and thermoplastic material begin to cool and the thermoplastic material solidifies. In one or more embodiments, cooling is expedited by convection due to coolant flowing through cooling lines the mold. The mold is opening and the bullet removed. Sprue pieces may be trimmed from the bullet as needed.

Figure 6B:
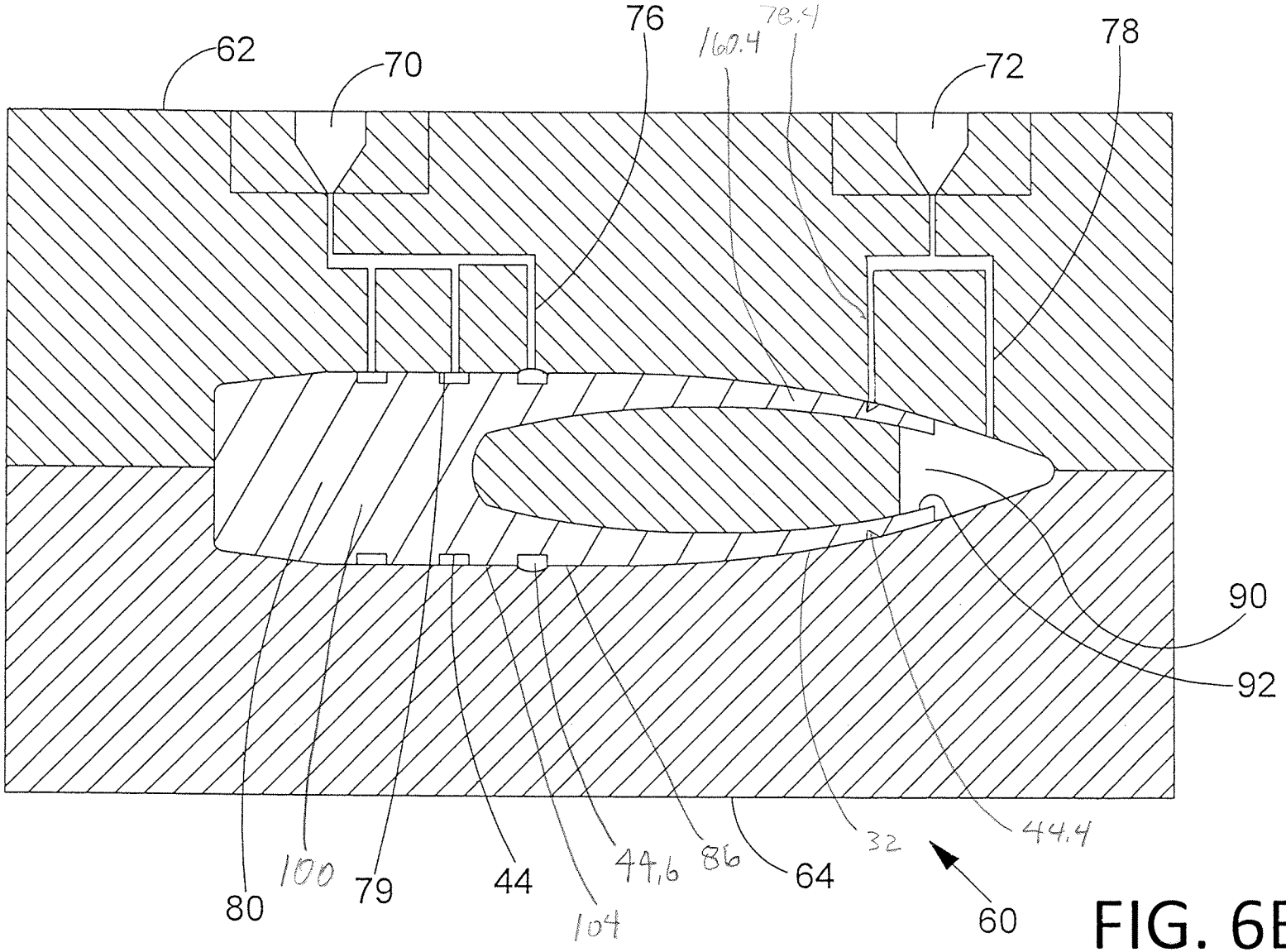
FIG. 6B is a cross-sectional view of mold with a bullet therein prior to overmolding polymer bands including a band on the ogive portion thereon.

Referring to FIG. 6B, a mold suitable for alternate overmolded components on bullets are illustrated. The sprue 78.4 extends to a circumferential groove 44.4 positioned on the ogive or nose portion 32. Said groove, with the polymer band therein, rather than providing reduced barrel friction and enhanced sealing capabilities that are provided by the grooves and bands on the barrel engaging portion, the ogival band facilitates pedaling of the jacket 160.4 thereby facilitating bullet expansion. The mold for the forwardmost groove 44.6 on the barrel engaging portion 104 has been shaped to provide an overmolded polymer band that projects radially outwardly with respect to the outer surface 86 of the projectile body 100. Such a band can provide sealing of the bullet in the case. See FIG. 24 and discussion associated therewith.

Figure 6C:
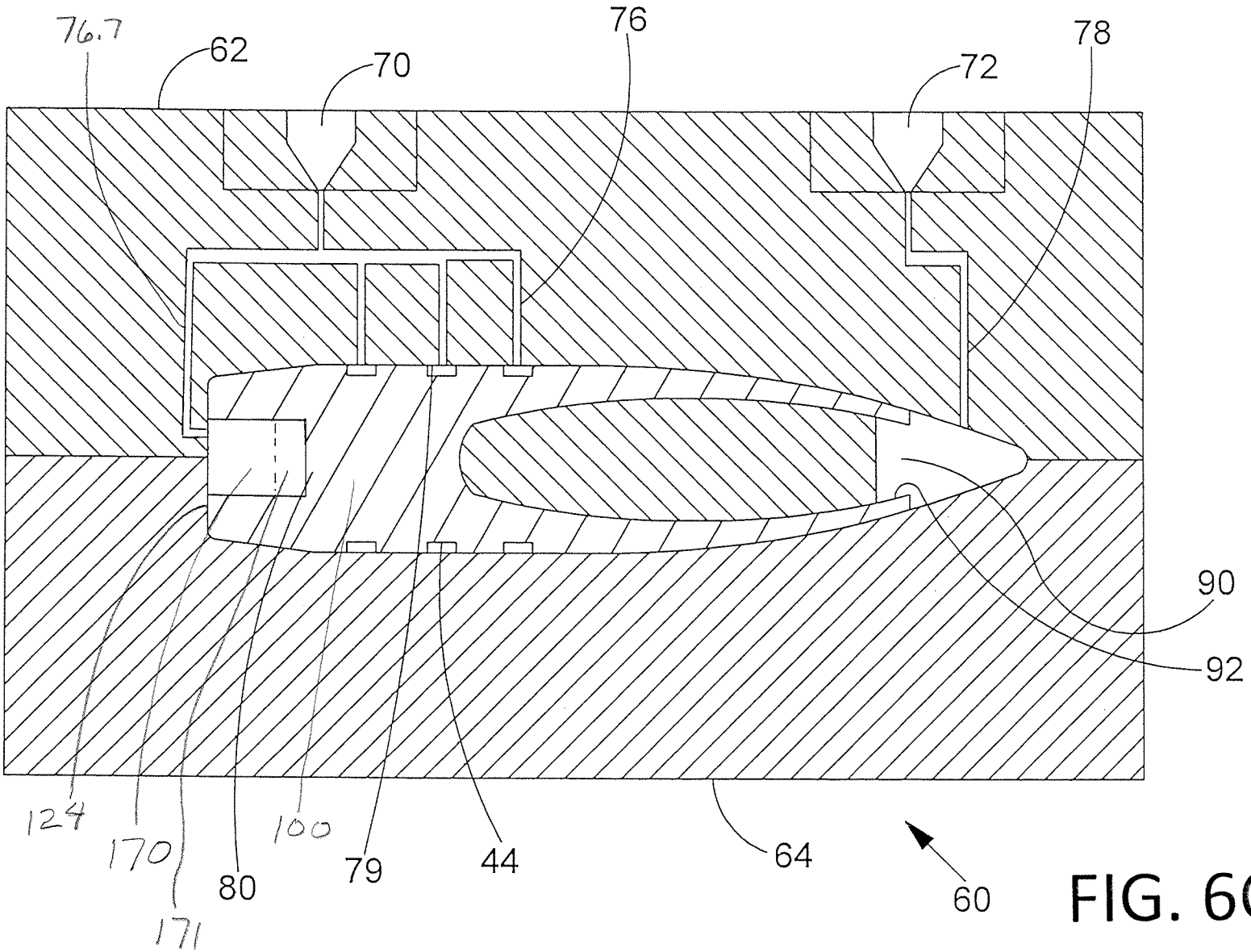
FIG. 6C is a cross-sectional view of mold with a bullet therein prior to overmolding polymer bands and a rearward plug.

Referring to FIG. 6C, a mold suitable for a further alternate overmolded component is illustrated. The projectile body 100A has a central axially extending cavity 170 projecting inwardly from the rearward facing surface 124. The cavity can be used for payload, core material, tracer material or other uses in, for example, the forward portion 171, and then be sealed with a overmolded polymer plug by way of sprue 76.7. See FIG. 18C and discussion associated therewith.

Figure 7:
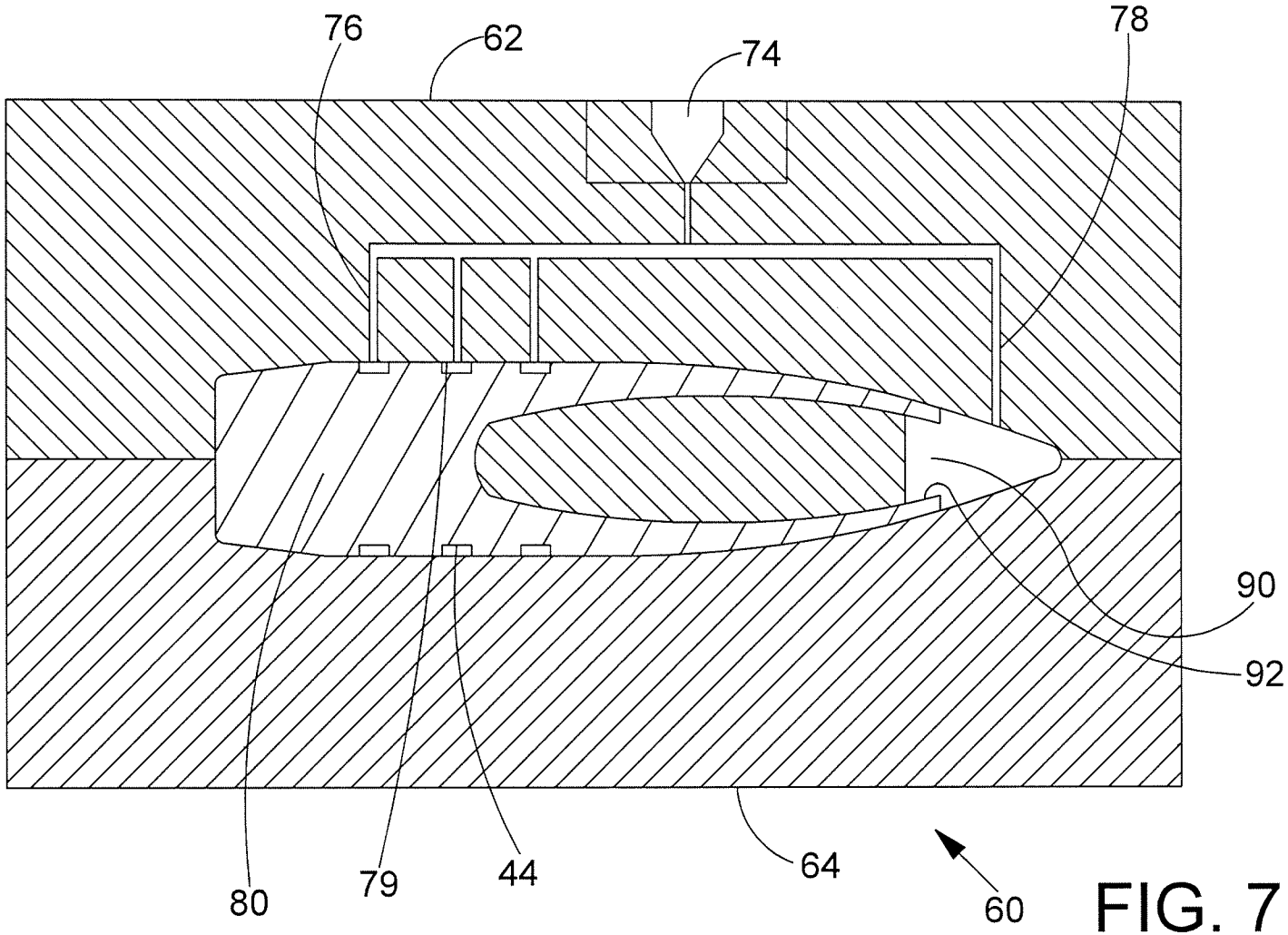
FIG. 7 is a cross-sectional view of mold with a bullet therein prior to overmolding polymer bands thereon.
Figure 8:
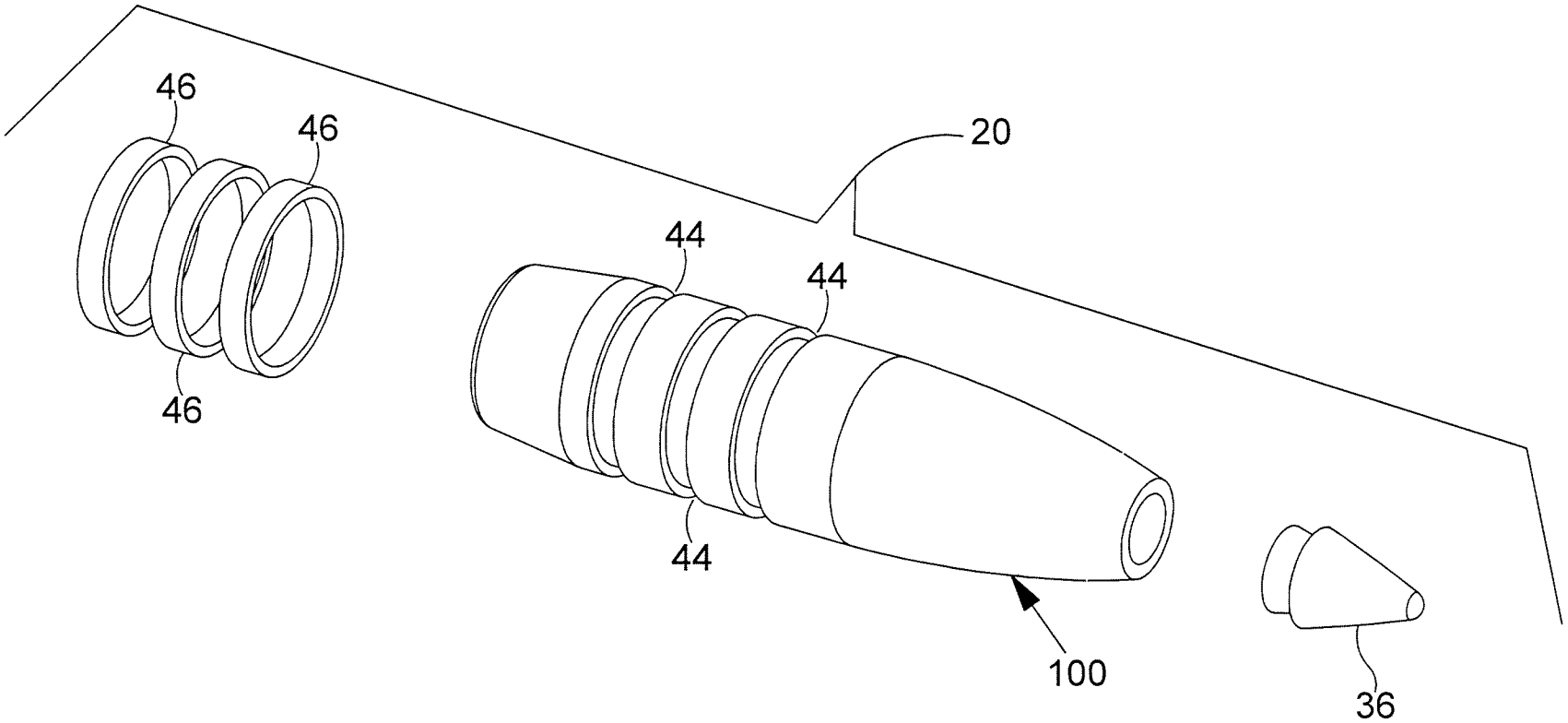
FIG. 8 is an exploded perspective view of a bullet in accordance with the detailed description.
Figure 9:
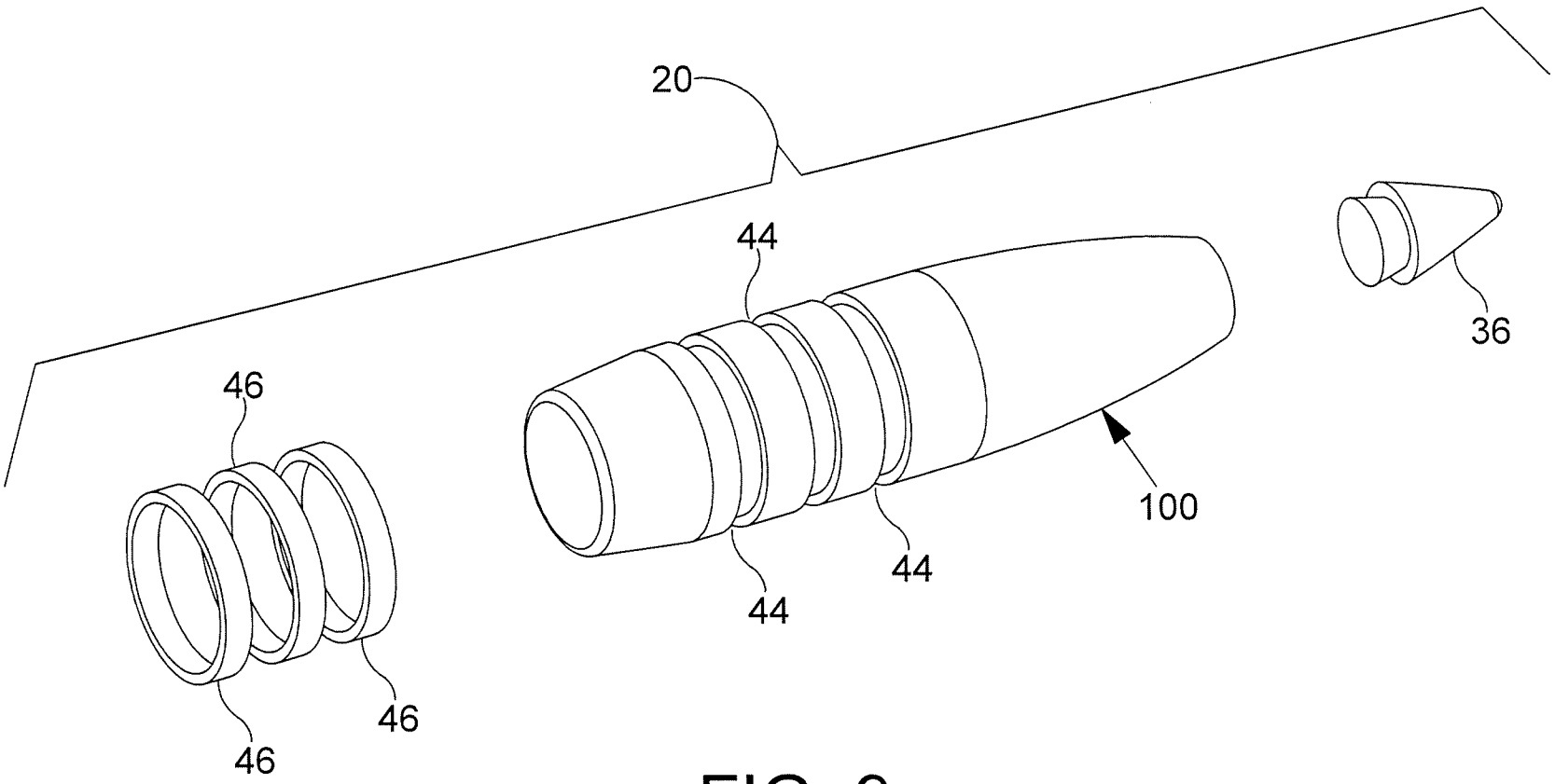
FIG. 9 is an exploded perspective view of a bullet in accordance with the detailed description.
Figure 10:
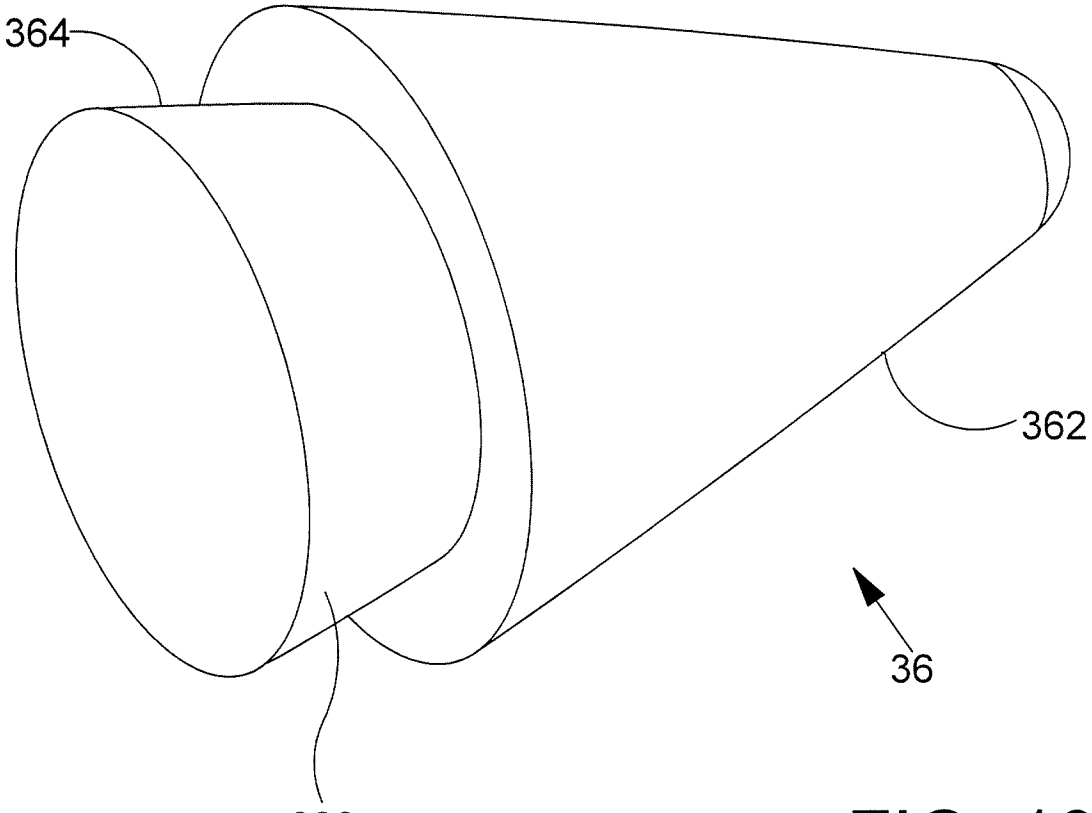
FIG. 10 is an enlarged perspective view further illustrating the tip member of the bullet shown in FIG. 9.
Figure 11A:
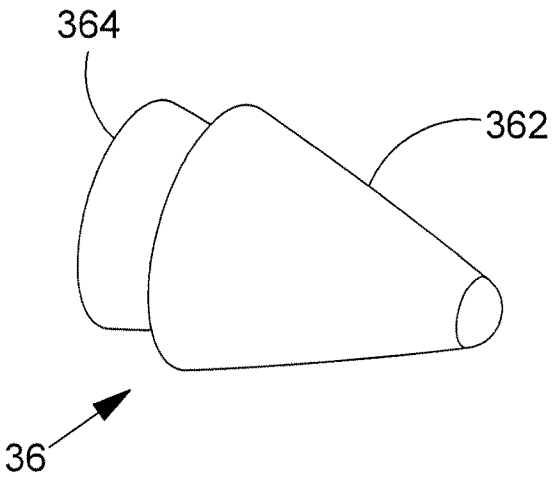
FIG. 11A is an enlarged perspective view further illustrating the tip member of the bullet shown in FIG. 8.
Figure 11B:
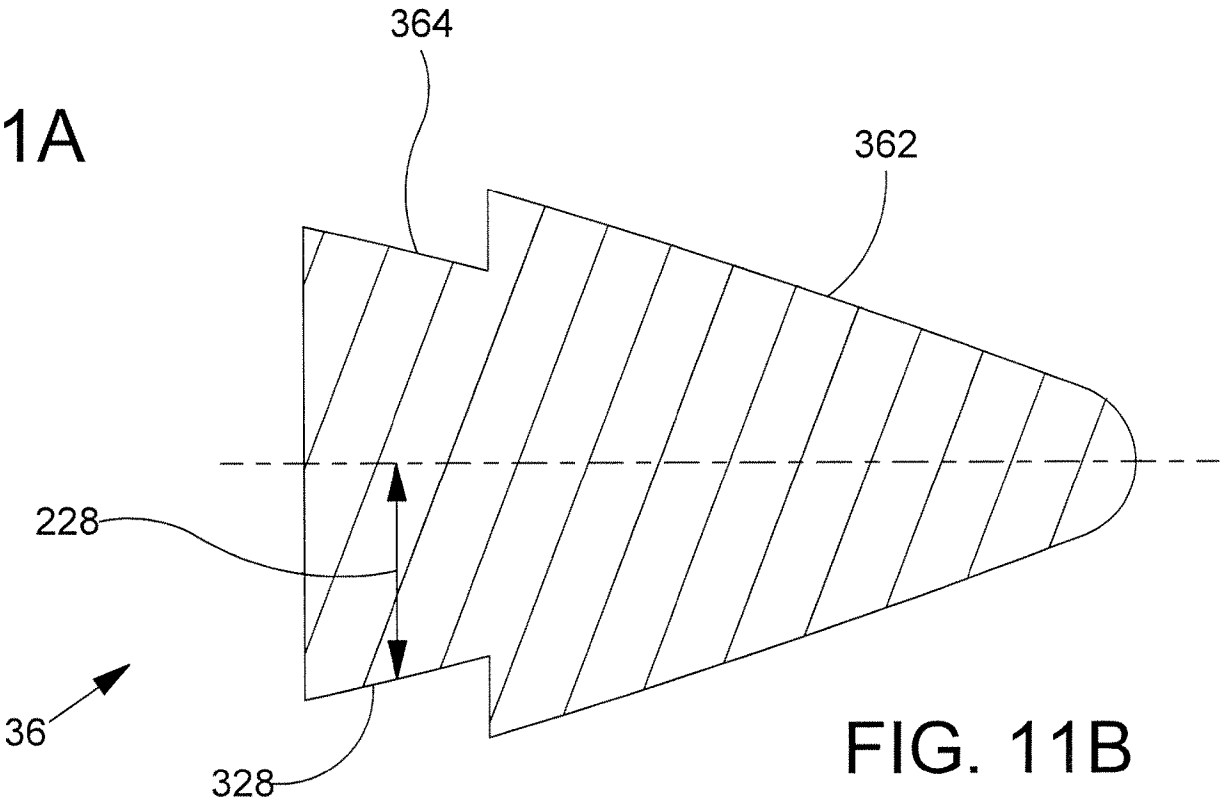
FIG. 11B is an enlarged side view further illustrating the tip member of the bullet shown in FIG. 11A.
Figure 12:
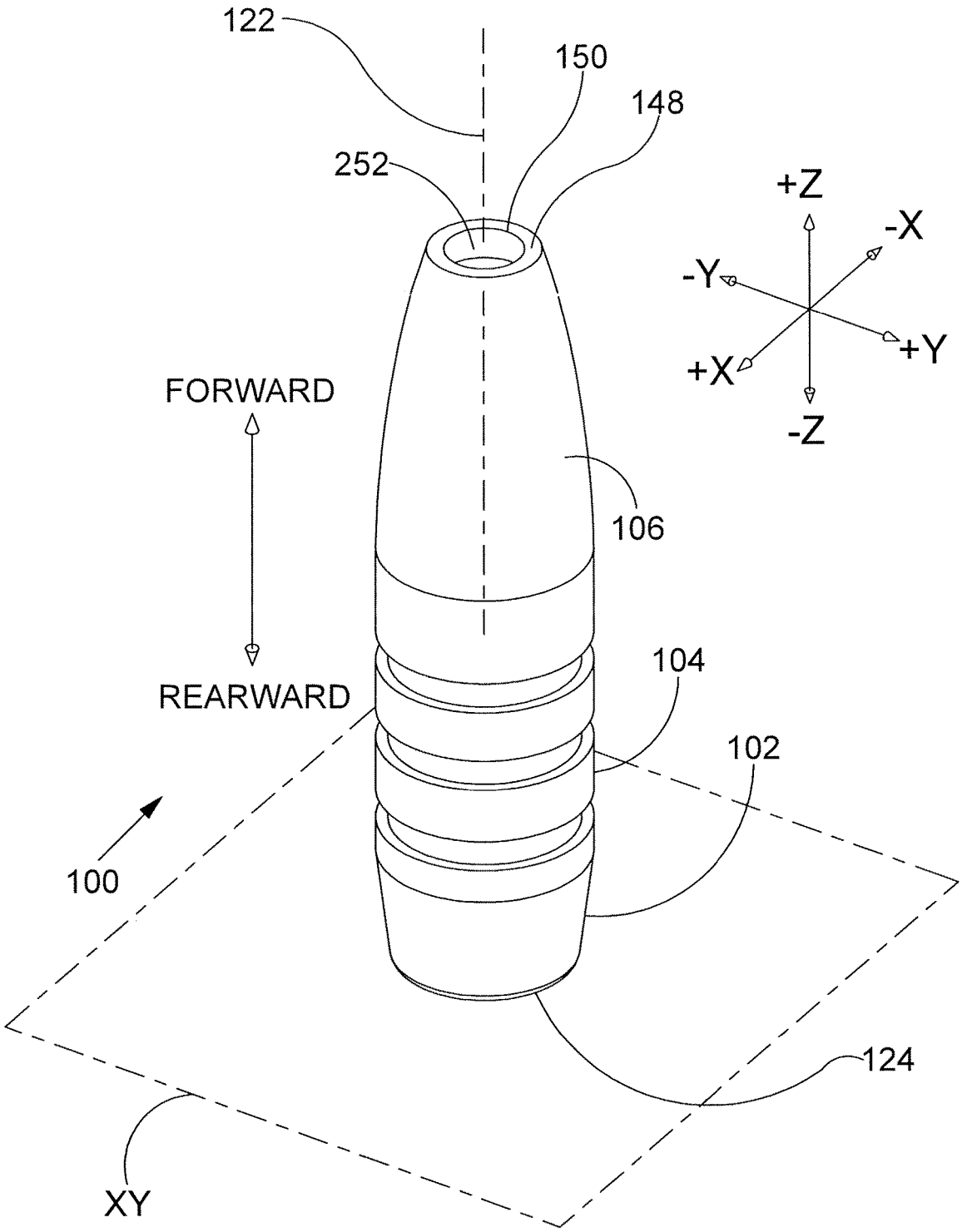
FIG. 12 is a perspective view showing a projectile body in accordance with the detailed description.
Figure 13:
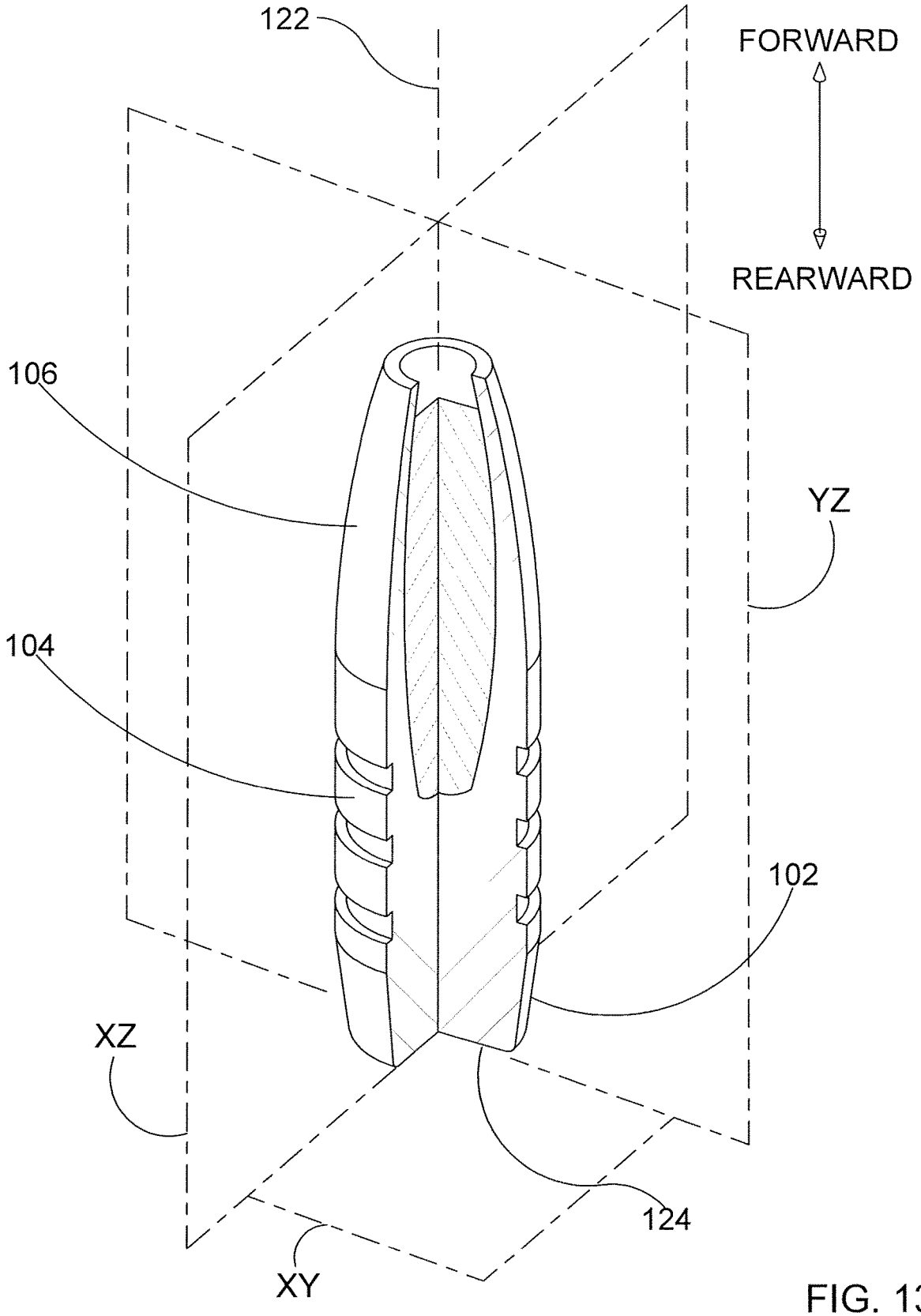
FIG. 13 is a perspective view of a projectile body in accordance with the detailed description. In the embodiment of FIG. 13, the projectile body has been sectioned along a plane YZ and a plane XZ.
Figure 14:
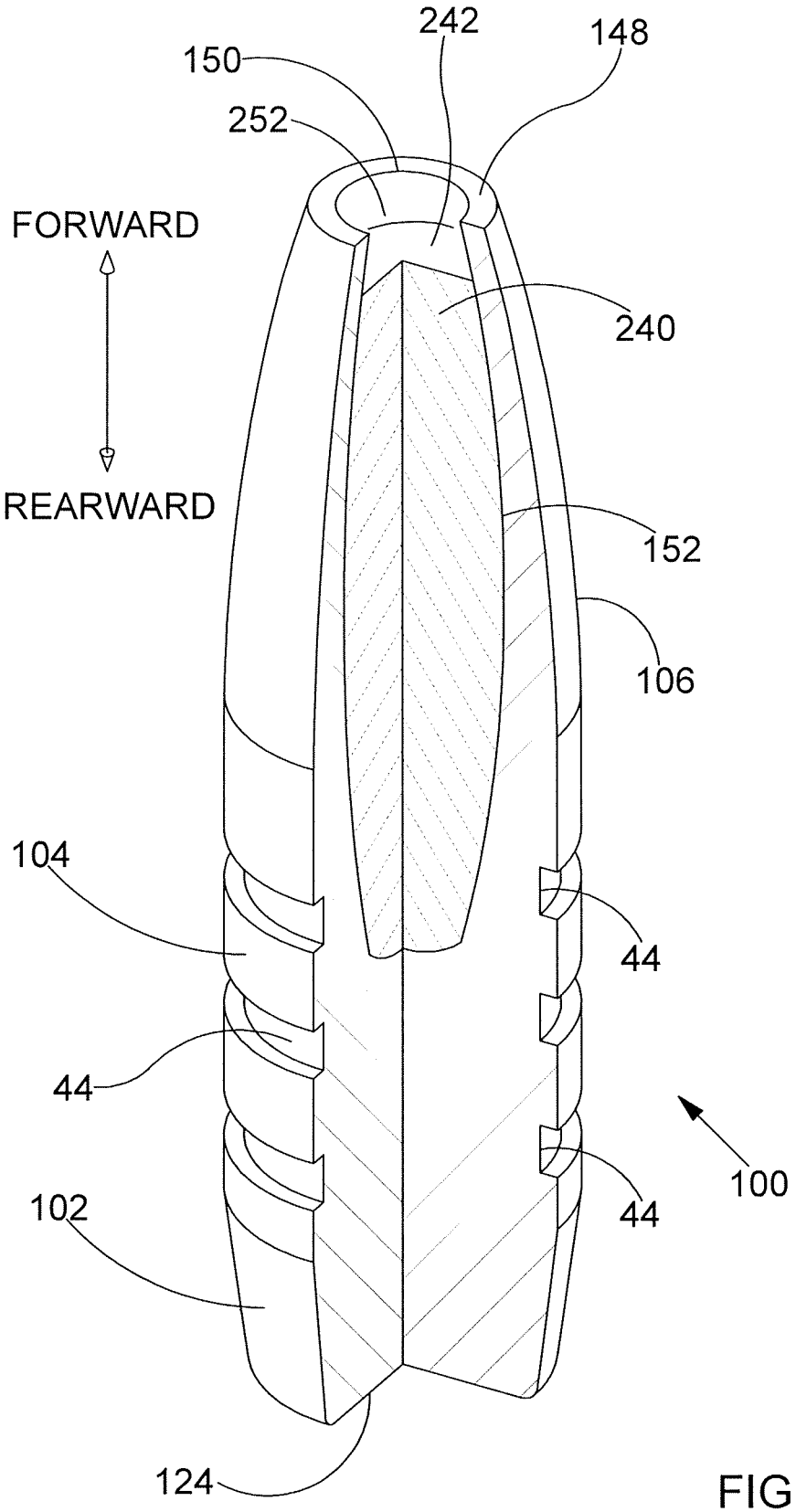
FIG. 14 is an enlarged perspective view of the projectile body shown in FIG. 13.
Figure 15:
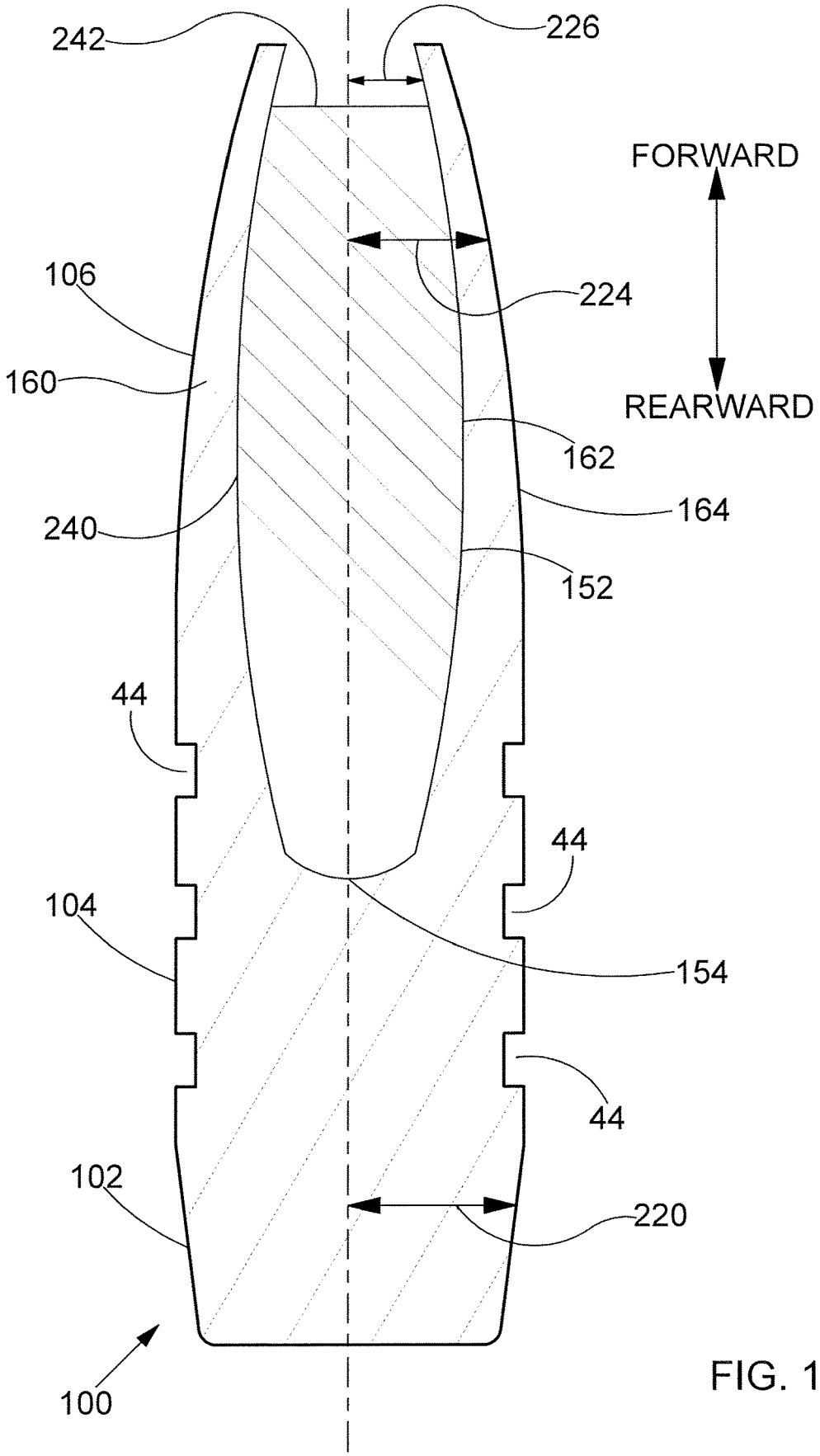
FIG. 15 is a cross-sectional view of the projectile body shown in FIG. 13 and FIG. 14.
Figure 16A:
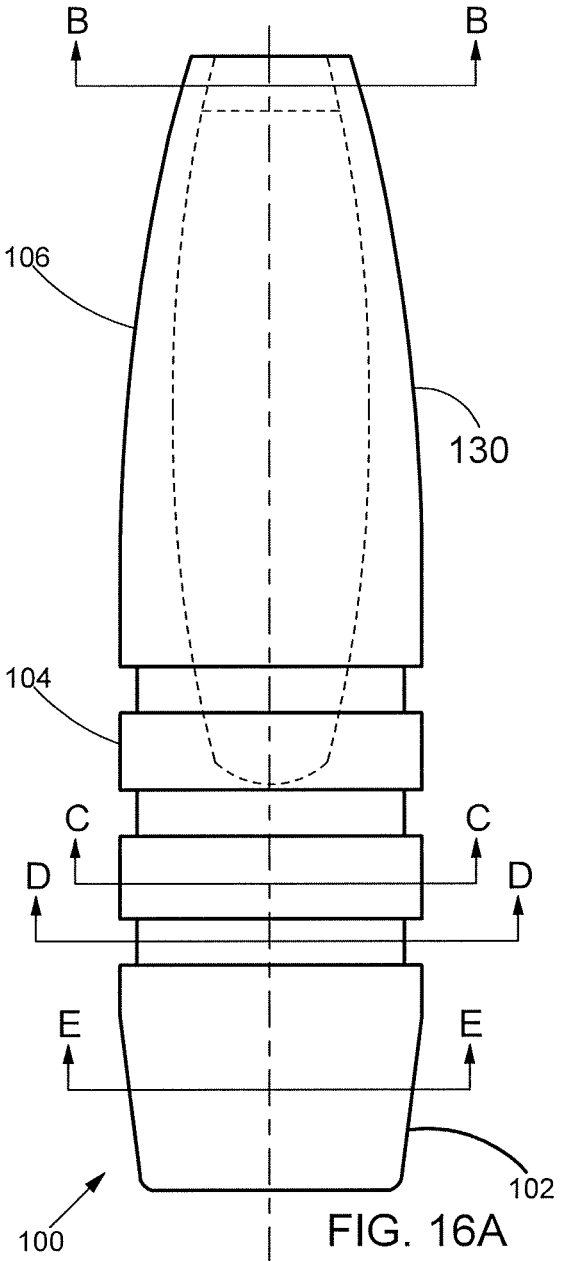
FIG. 16A is a side view of a projectile body in accordance with the detailed description.
Figure 16B:
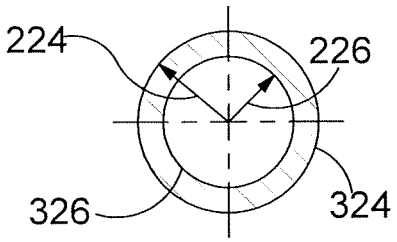
FIG. 16B is a cross-sectional view of the projectile body shown in FIG. 16A taken along section line B-B shown in FIG. 16A.
Figure 16C:
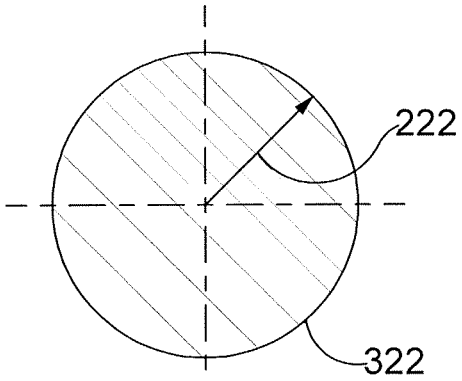
FIG. 16C is a cross-sectional view of the projectile body shown in FIG. 16A taken along section line C-C shown in FIG. 16A.
Figure 16E:
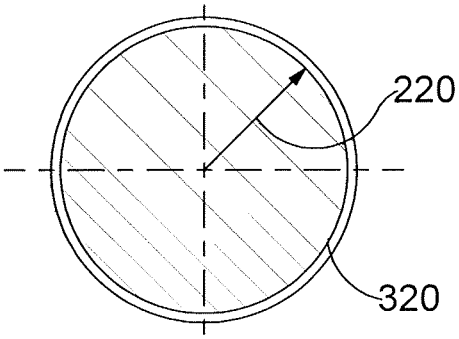
FIG. 16E is a cross-sectional view of the projectile body shown in FIG. 16A taken along section line E-E shown in FIG. 16A.
Figure 16D:
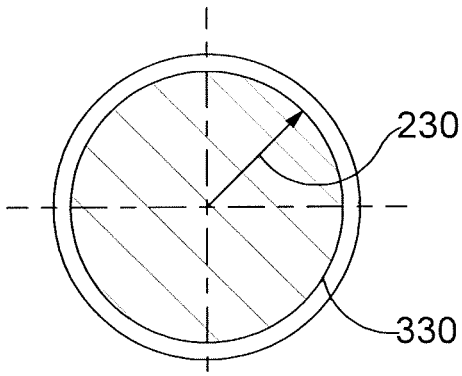
FIG. 16D is a cross-sectional view of the projectile body shown in FIG. 16A taken along section line D-D shown in FIG. 16A.
Figure 17A:
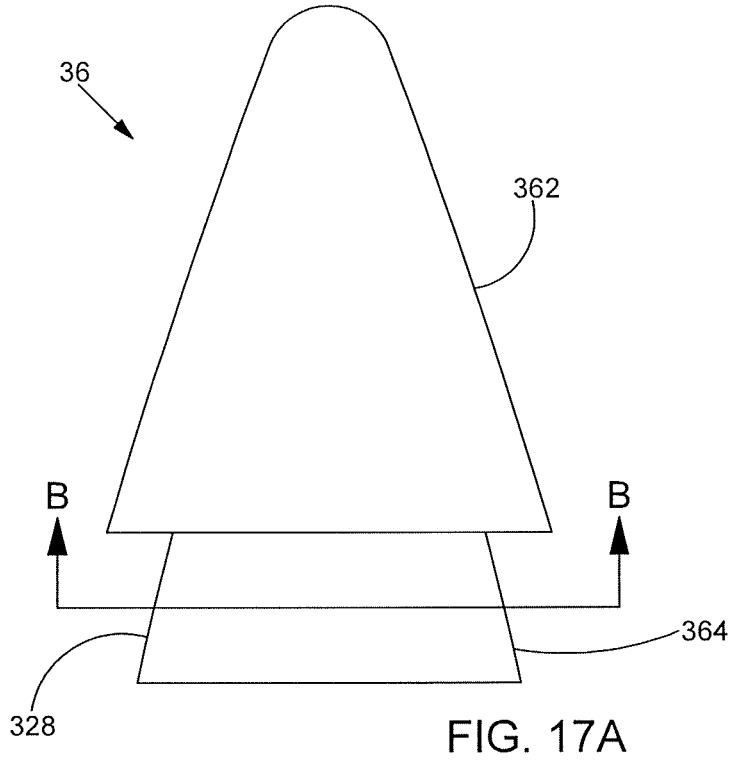
FIG. 17A is a side view of a tip member in accordance with the detailed description.
Figure 17B:
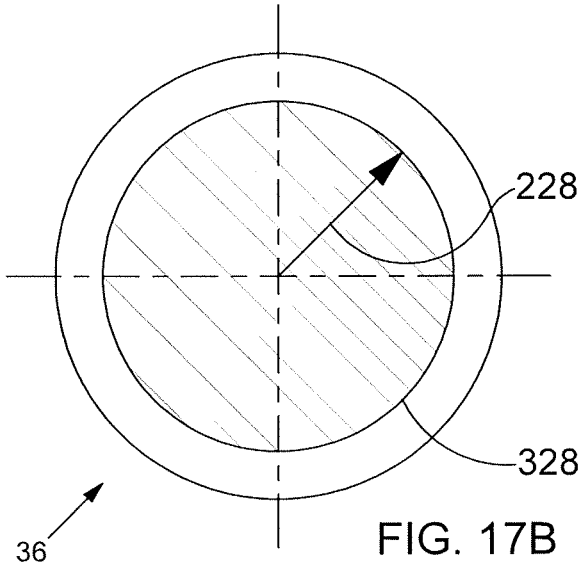
FIG. 17B is a cross-sectional view of the tip member shown in FIG. 17A taken along section line B-B shown in FIG. 17A.

Referring to FIG. 7, a mold 60 comprising two mold halves 62, 64 is shown. The mold 60 also include a nozzle port 74 and sprues 76, 78 for injection molding molten polymers. The sprues 76 leading to the grooves in the bullet body 80 effect the overmolding of the bands in the grooves. The sprue 78 provides molten polymer to a tip cavity for forming a polymer tip. In one or more embodiments, the mold wall surface 79 is flush at the location of the grooves and the adjacent body portions. In one or more embodiments, a front cavity 90 defined by the bullet body 80 includes an undercut portion 92 for providing a mechanical lock with the polymer tip. In the example embodiment of FIG. 7, the sprue 76 and the sprue 79 are in fluid communication with one another. Also in the embodiment of FIG. 7, the front cavity 90 is in fluid communication with the grooves defined by the bullet body 80 via the sprues 76, 78.

Referring to FIGS. 1 through 21C, a projectile 20 comprises a projectile body 100, one or more polymer bands 44 and a polymer tip member 36. In one or more embodiments, the projectile body 100 includes a tail portion 102, a nose portion 106 and a barrel engaging portion 104 extending rearwardly between the nose portion 106 and the tail portion 102. In one or more embodiments, the portions of the projectile body 100 are arranged along a central longitudinal axis 122. In one or more embodiments, the tail portion 102 has a rearward facing surface 124 defining an XY plane. In these embodiments, the tail portion 102 extends forwardly along the central longitudinal axis 122 of the projectile body 100 between the rearward facing surface 124 and the barrel engaging portion 104. In one or more embodiments, the central longitudinal axis 122 is orthogonal to the XY plane. In one or more embodiments, the tail portion 102 has a tail radius 220 extending between the central longitudinal axis 122 and an outer tail surface 320 of the tail portion 102. In one or more embodiments, the tail radius 220 increases as the tail portion 102 extends forwardly along the central longitudinal axis 122.

In one or more embodiments, the barrel engaging portion 104 of the projectile body 100 extends forwardly along the central longitudinal axis 122 between the tail portion 102 and the nose portion 106. The barrel engaging portion 104 has a barrel engaging radius 222 extending between the central longitudinal axis 122 and a barrel engaging surface 322 of the barrel engaging portion 104. In one or more embodiments, the barrel engaging portion 104 defines one or more circumferential grooves 44. In one or more embodiments, the projectile 20 comprising one or more polymer bands 46 with each polymer band 46 being disposed in one of the circumferential grooves 44 defined by the barrel engaging portion 104.

In one or more embodiments, the nose portion 106 of the projectile body 100 comprising a forward facing edge 148 defining an opening 150. In one or more embodiments, the nose portion 106 extends forwardly along the central longitudinal axis 122 between the barrel engaging portion 104 and the forward facing edge 148. In one or more embodiments, the nose portion 106 has a nose radius 224 extending between the central longitudinal axis 122 and an outer nose surface 324 of the nose portion 106. In one or more embodiments, the nose radius 224 decreases as the nose portion 106 extends forwardly along the central longitudinal axis 122. In one or more embodiments, the nose portion has a shape generally corresponding to the shape of an ogive.

In one or more embodiments, the projectile body 100 comprises a body wall 160 extending between an interior wall surface 162 and an exterior wall surface 164. In one or more embodiments, the interior wall surface 162 defines an interior cavity 152 and the interior cavity fluidly communicates with the opening 150 defined by the forward facing edge 148 of the nose portion 106. In one or more embodiments, the interior cavity 152 extends rearwardly from the opening 150 to a cavity end point 154 within the projectile body 100.

Referring to FIGS. 14-18C, in embodiments, a core member 240 is disposed inside the interior cavity 152. In one or more embodiments, the core member 240 comprises a forward facing surface 242 and the core member 240 extends rearward from the forward facing surface 242 to the interior cavity end point 154 within the projectile body 100. In one or more embodiments, the forward facing surface 242 of the core member 240 and the interior wall surface 162 define a forward portion 252 of the interior cavity 152. In one or more embodiments, the forward portion 252 of the interior cavity 152 has a cavity radius 226 that decreases as the forward portion 252 of the interior cavity 152 extends forward from the forward facing surface 242 of the core member 240 to the opening 150.

In one or more embodiments, the projectile 20 includes a tip member 36 extending through the opening 150. In one or more embodiments, the tip member 36 has a distal portion 362 extending forward of the opening 150 and a proximal portion 364 extending rearward of the opening 150. In one or more embodiments, the proximal portion 364 of the tip member 36 has a tip retention radius 228 extending between the central longitudinal axis 122 and a tip retention surface 328 of the proximal portion 364 of the tip member 36. In one or more embodiments, the tip retention radius 228 increases as the proximal portion 364 of the tip member 36 extends rearward from the opening 150 to the forward facing surface 242 of the core member 240.

Referring to FIGS. 15-18C, in embodiments, each circumferential groove 44 is partially defined by a groove root surface 330. In one or more embodiments, each groove root surface 330 has a groove root radius 230 extending between the central longitudinal axis 122 and the groove root surface. In one or more embodiments, the barrel engaging portion 104 has a barrel engaging radius 222 extending between the central longitudinal axis 122 and a barrel engaging surface 322 of the barrel engaging portion 104. In one or more embodiments, the barrel engaging portion 104 defines one or more circumferential grooves 44. In one or more embodiments, each circumferential groove 44 has a groove depth extending between the groove root surface 330 and the barrel engaging surface 322. In one or more embodiments, the projectile 20 comprising one or more polymer bands 46 with each polymer band 46 being disposed in one of the circumferential grooves 44 defined by the barrel engaging portion 104. In one or more embodiments, each polymer band 46 has a band thickness extending between the groove root surface 330 and the barrel engaging surface 322.

Figure 18A:
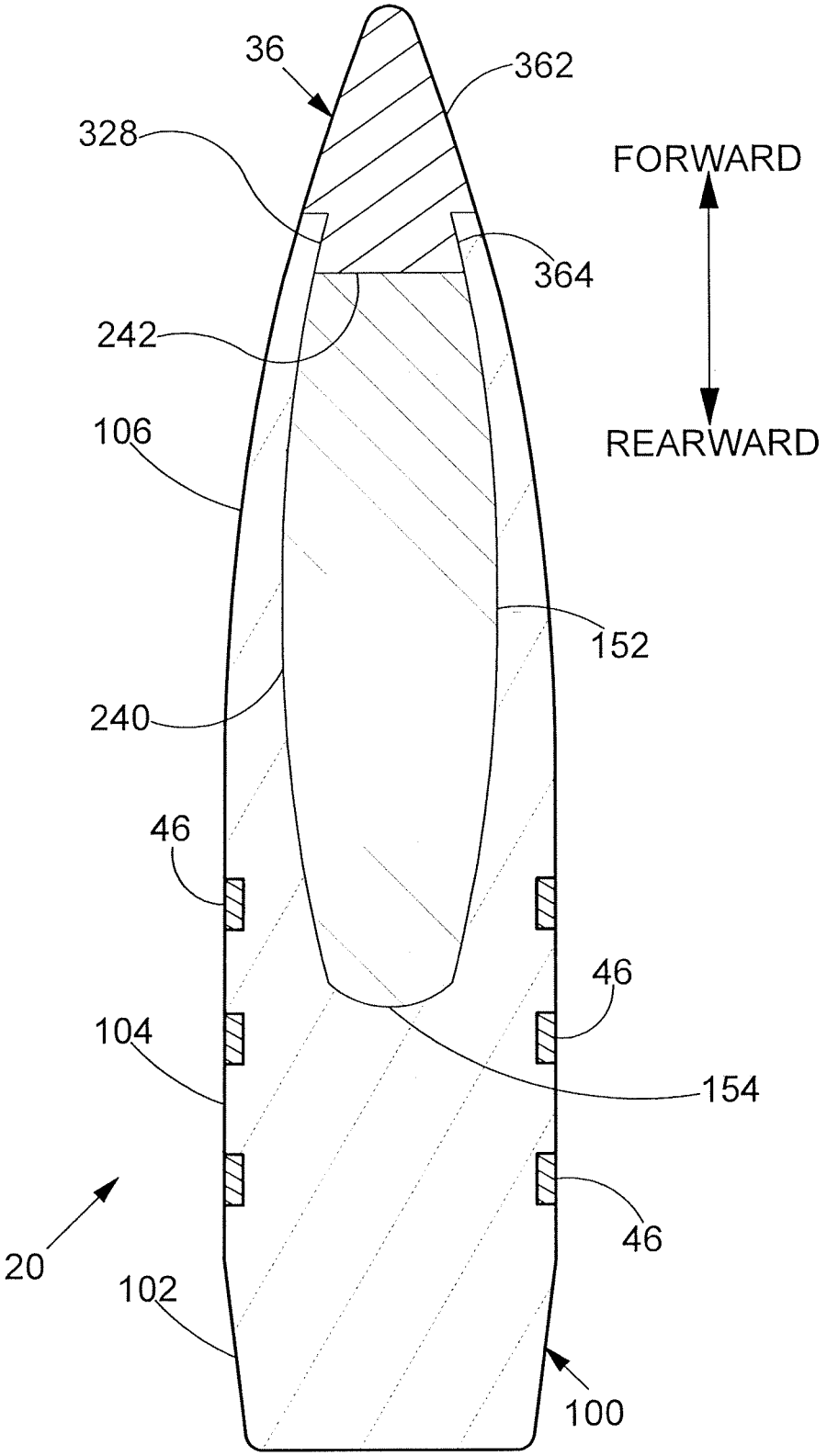
FIG. 18A is a cross-sectional view of a projectile including a projectile body with polymer bands on a barrel engaging portion band a polymer tip member.
Figure 18B:
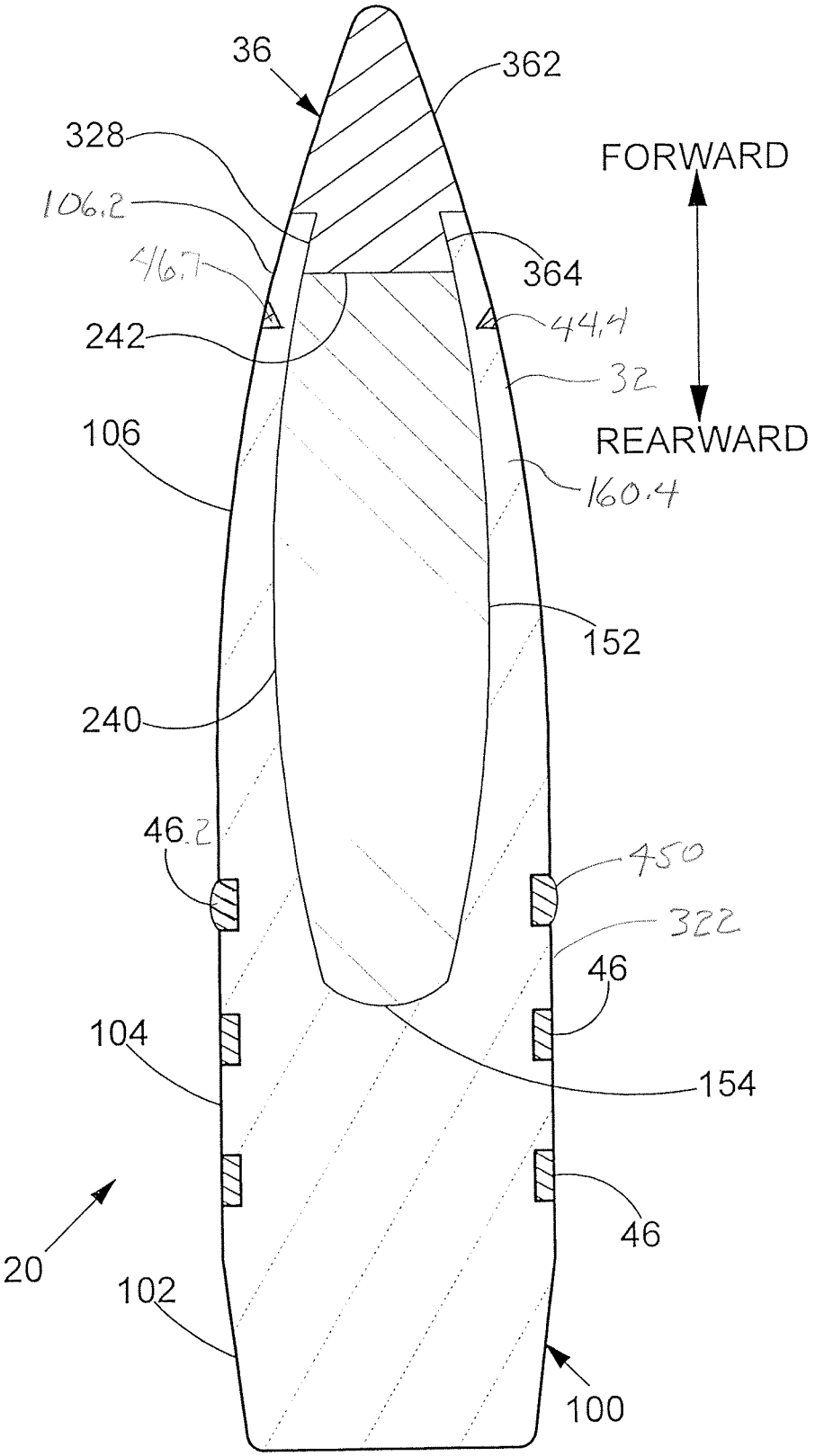
FIG. 18B is a cross-sectional view of a projectile including a projectile body with polymer bands including a band protruding radially beyond surface of the projectile body and a circumferential groove on the ogive portion with a polymer band therein.
Figure 18C:
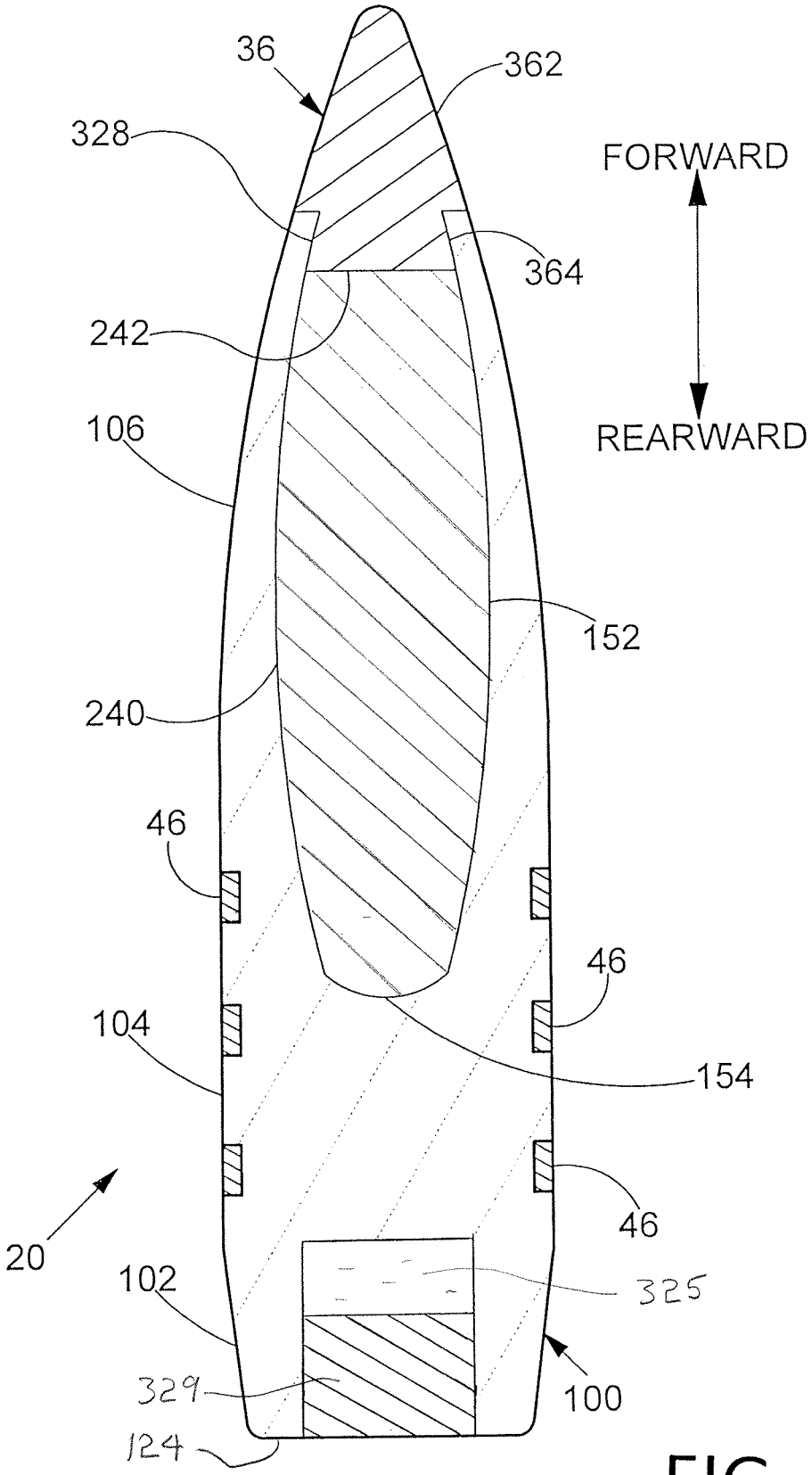
FIG. 18C is a cross-sectional view of a projectile including a projectile body with polymer bands on a barrel engaging portion, a polymer tip member, and an over molded rear plug.
Figure 19A:
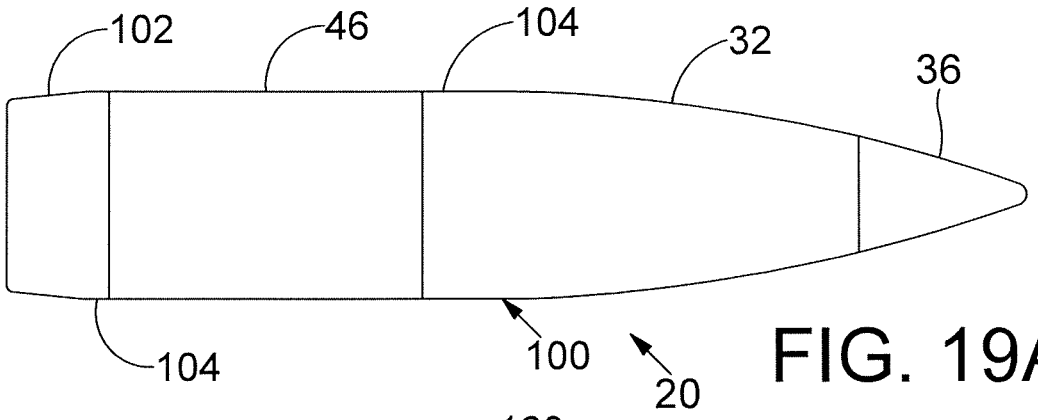
FIG. 19A depicts a side elevation view of rifle bullet, according to one or more embodiments.
Figure 19B:
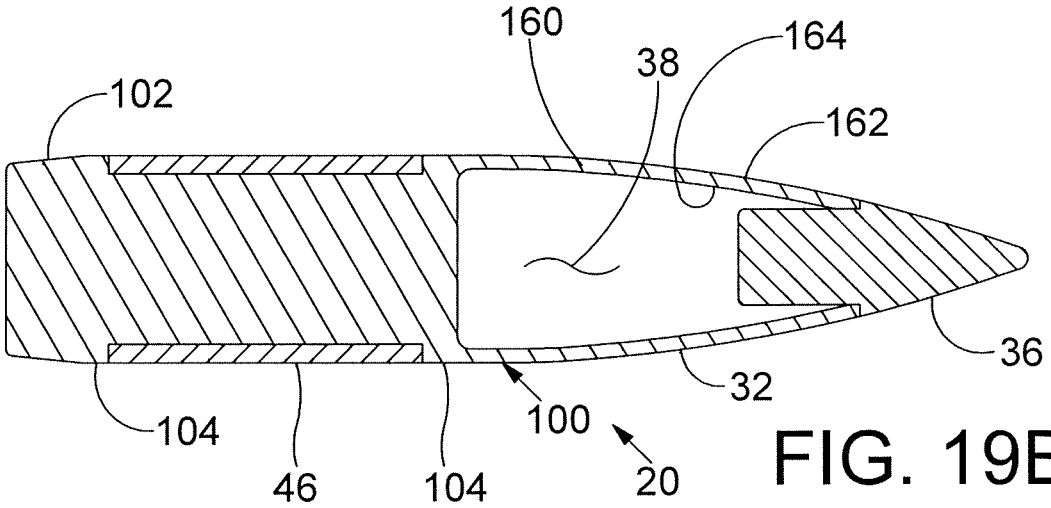
FIG. 19B is a cross-sectional view of the bullet shown in FIG. 19A.
Figure 19C:
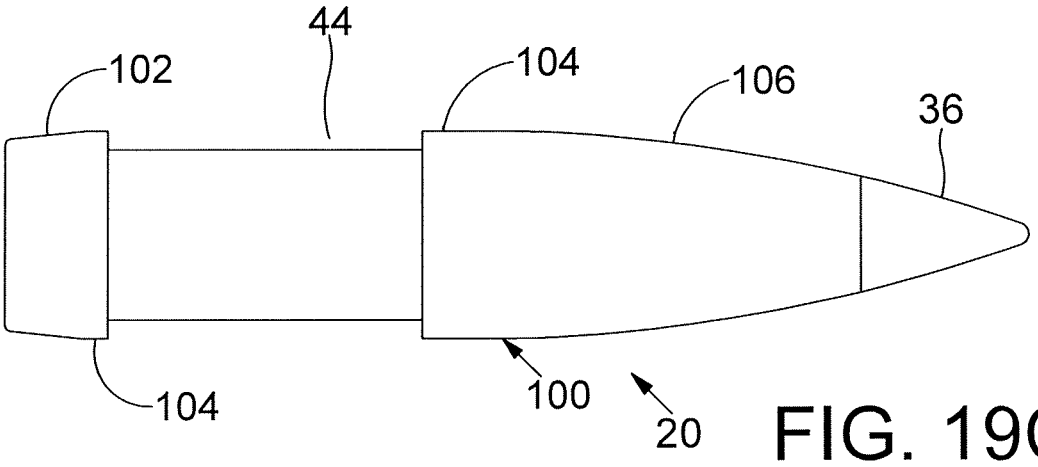
FIG. 19C depicts a side elevation view of the bullet body shown in FIG. 19A before the overmolding process.
Figure 20A:
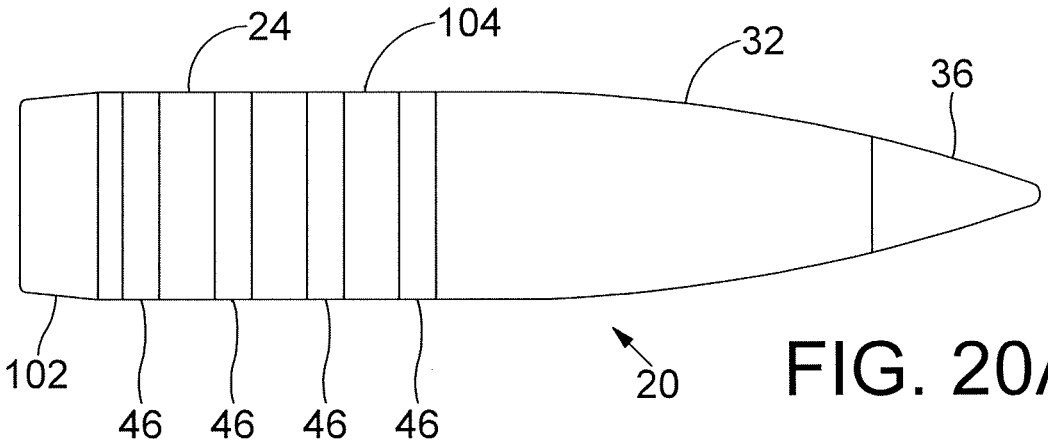
FIG. 20A depicts a side elevation view of rifle bullet, according to one or more embodiments.
Figure 20B:
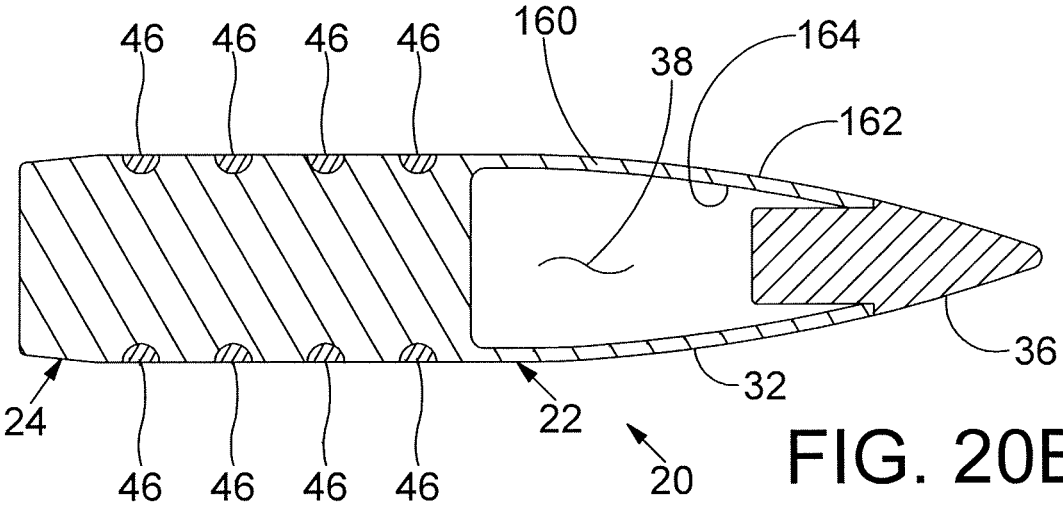
FIG. 20B is a cross-sectional view of the bullet shown in FIG. 20A.
Figure 20C:
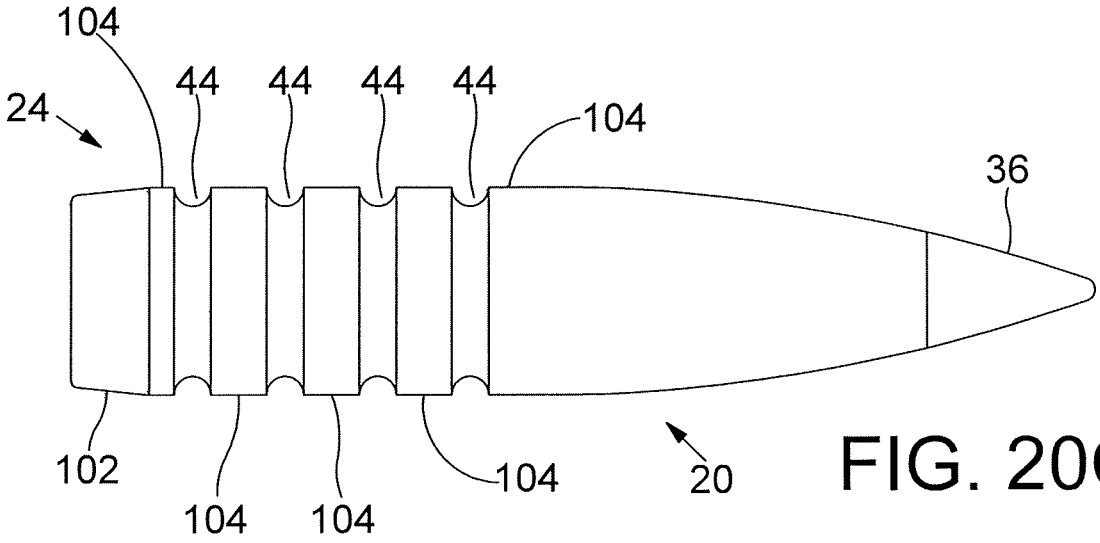
FIG. 20C depicts a side elevation view of the bullet body shown in FIG. 20A before the overmolding process.
Figure 21A:
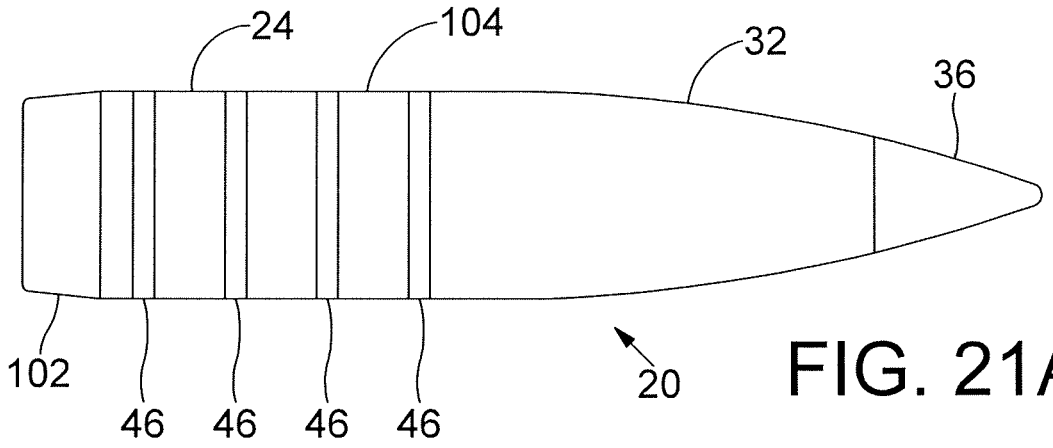
FIG. 21A depicts a side elevation view of rifle bullet, according to one or more embodiments.
Figure 21B:
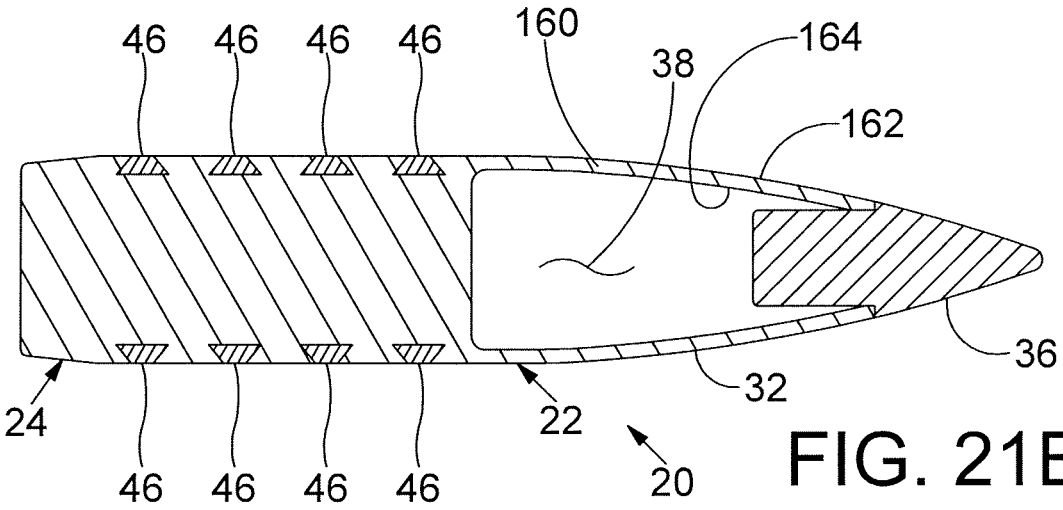
FIG. 21B is a cross-sectional view of the bullet shown in FIG. 21A.
Figure 21C:
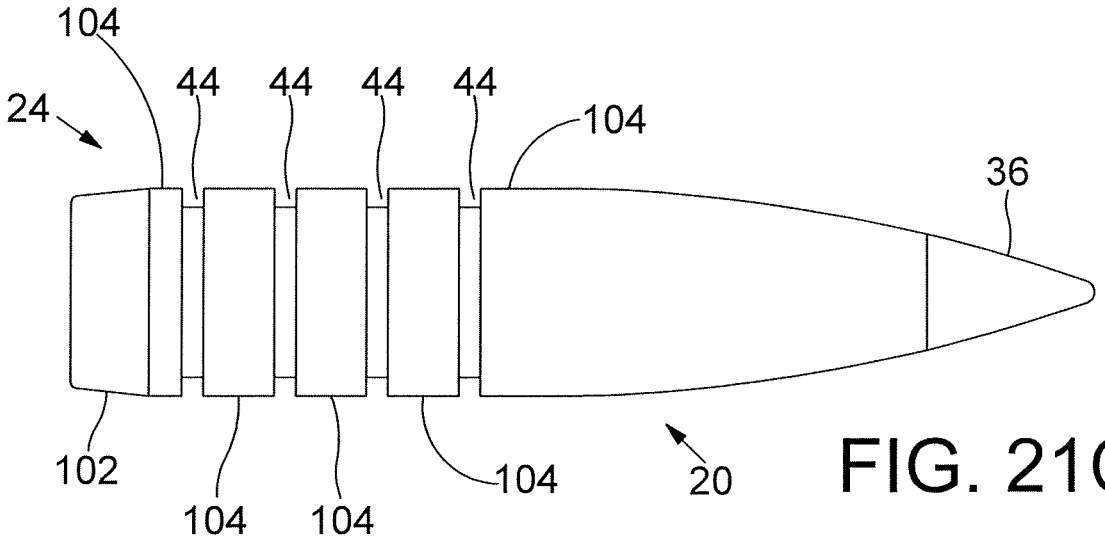
FIG. 21C depicts a side elevation view of the bullet body shown in FIG. 21A before the overmolding process.
Figure 24:
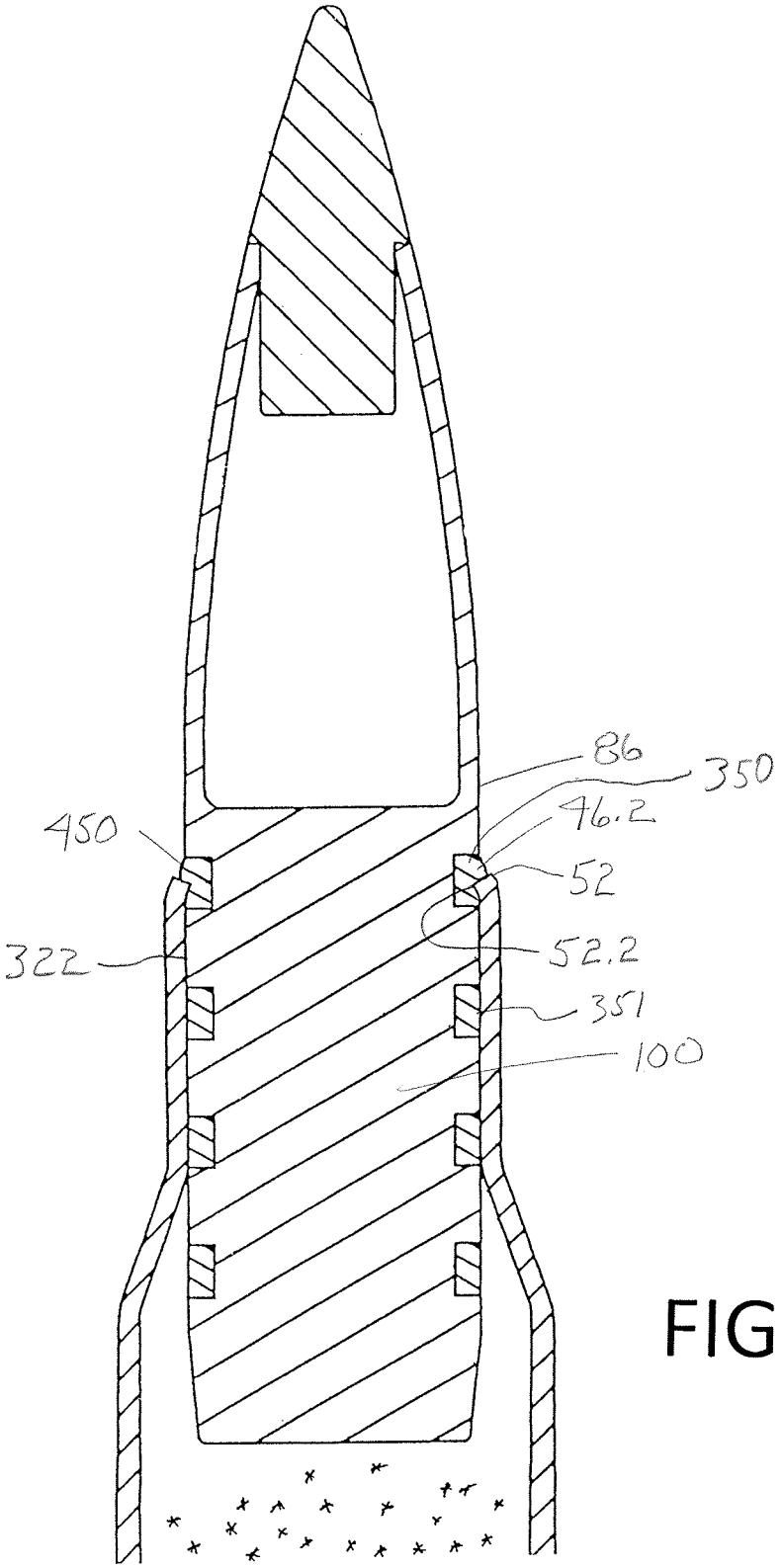
FIG. 24 is a cross-sectional view of a projectile in a cartridge case with the forwardmost polymer band having the leading edge of the case crimped therein.

Referring in particular to FIGS. 18B and 24, the forward-most polymer band 46.2 on the barrel engaging portion 104 may have a convex outer surface 450 suitable for providing enhanced sealing with the case. The surface projects radially outward beyond the surface 322 of the barrel engaging portion. Referring to FIG. 18B, a groove 44.4 may be provided in the ogive or nose portion 32 with an ogival overmolded polymer band 46.7 therein. The groove or cannelure in which this band is overmolded can facilitate specific deformation characteristics of the jacket, such as pedaling. The overmolded band therein, being flush with the ogival surface 106.2, may eliminate negative aerodynamic effects, such as drag, that otherwise would occur with the groove. The ballistic coefficient of the projectile without the groove may be maintained.

Referring to 18C, a central cavity 170 in the projectile body 100 extends rearwardly from the rearward facing surface 124 of the tail portion 102. A payload 325 may be in the cavity with an overmolded polymer plug 329 sealing the payload therein. The plug being flush with the rearward facing surface 124.

In an embodiment, the barrel engaging radius is between 0.07 inches and 0.25 inches. In an embodiment, the barrel engaging radius is between 0.08 inches and 0.18 inches. In an embodiment, the projectile body is integrally formed from a unitary piece of metal. In an embodiment, the projectile body comprises a metal. In an embodiment, the projectile body comprises copper. In an embodiment, the projectile has a weight between 30 grains and 300 grains. In an embodiment, the projectile has a weight between 50 grains and 200 grains.

Figure 22:
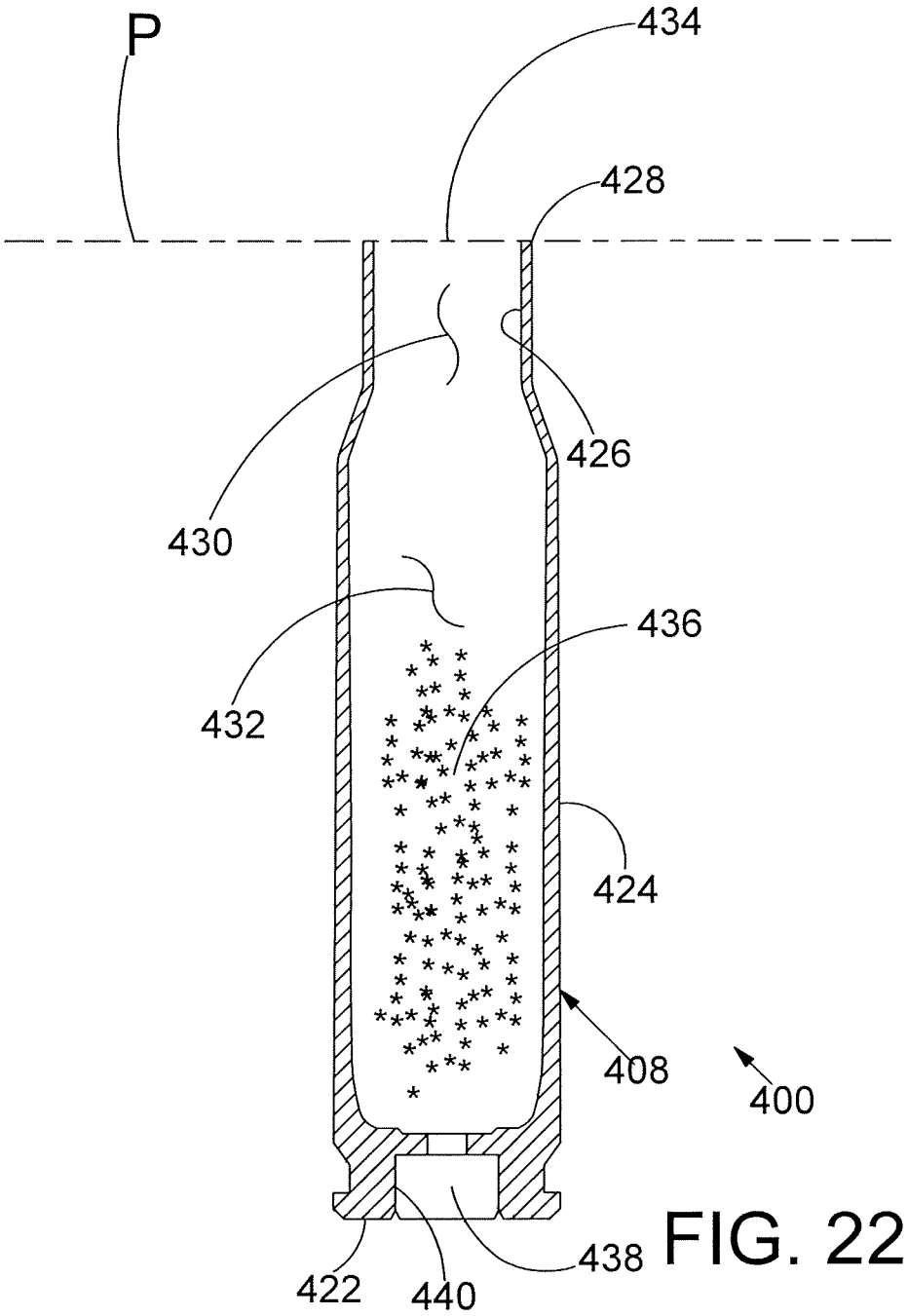
FIG. 22 is a cross-sectional view of an assembly including a cartridge case.
Figure 23:
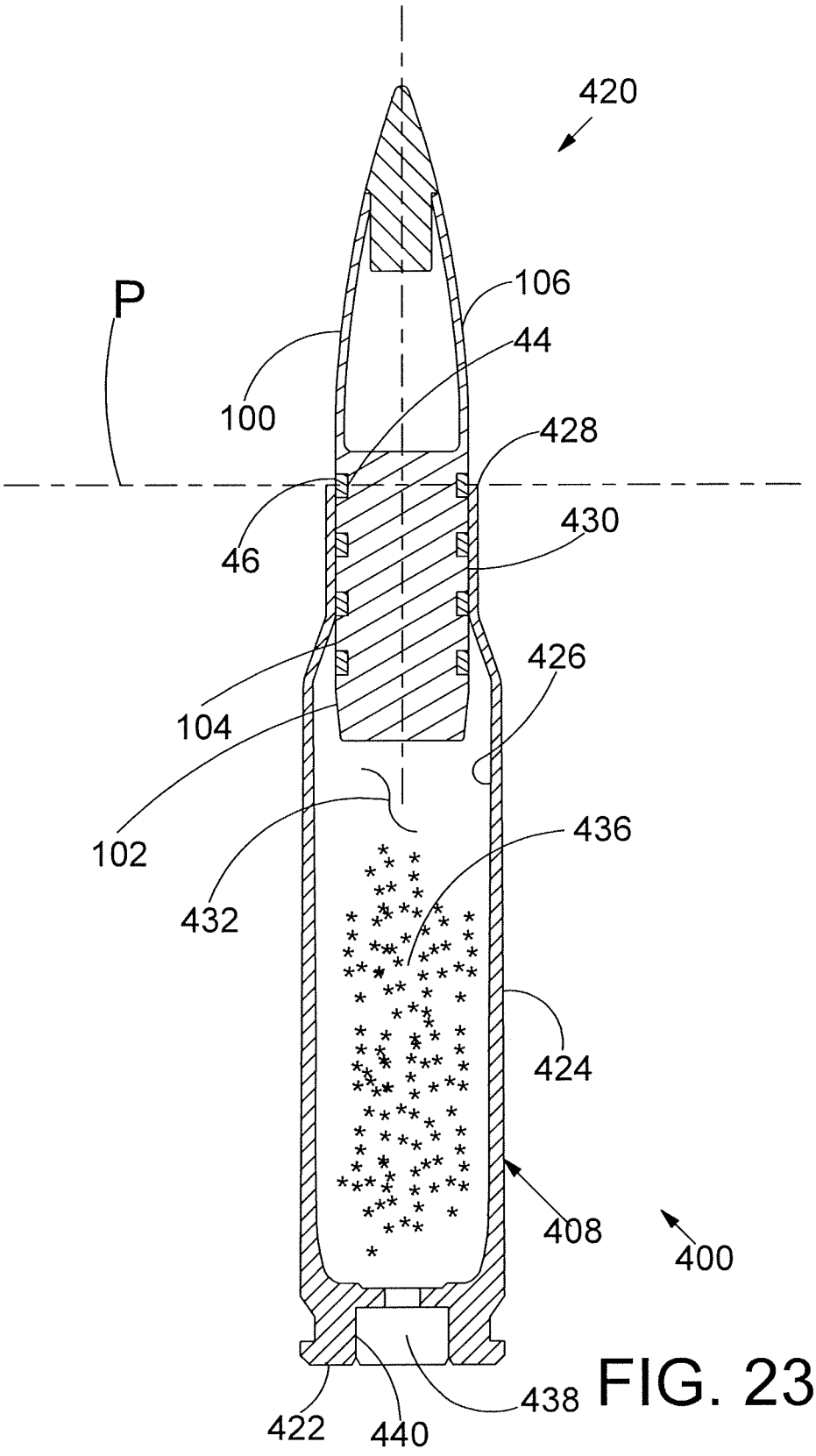
FIG. 23 is a cross-sectional view of a cartridge including a cartridge case and a projectile.

Referring to FIG. 22 and FIG. 23, an ammunition cartridge 400 in accordance with one or more embodiments comprises a case 408 comprising a base portion 422 and a case wall 424 extending forward from the base portion 422 to a forward edge 428 of the case wall 424. An inner surface 426 of the case wall 424 defines a lumen 430, the lumen extending rearward from the forward edge 428 toward the base portion 422. In an embodiment, the base portion 422 and the inner surface 426 of the case wall 424 define a cavity 432 and the cavity 432 fluidly communicates with the lumen 430. In an embodiment, the inner surface 426 of the case wall 424 defines an opening 434 proximate the forward edge 428 of the case wall 424, the opening 434 fluidly communicating with the lumen 430. In an embodiment, a propellant charge 436 is disposed inside the cavity 432 for producing a quantity of propellant gas and a primer housing 438 is disposed in a hole 440 defined by the base portion 422 of the case 408, a priming material disposed inside the primer housing 438 for igniting the propellant charge 436. The ammunition cartridge also comprises a projectile 420 comprising a projectile body 100 including a tail portion 102, a nose portion 106, and a barrel engaging portion 104 extending rearwardly between the nose portion 106 and the tail portion 102, the portions of the projectile body 100 being arranged along a central longitudinal axis 122. In an embodiment, the barrel engaging portion 104 of the projectile body 100 extends forwardly along the central longitudinal axis 122 between the tail portion 102 and the nose portion 106. In an embodiment, the barrel engaging portion 104 defines one or more circumferential grooves 44. In an embodiment, the projectile 420 comprises a polymer band 46 disposed in the circumferential groove 44 defined by the barrel engaging portion 104 of the projectile body 100. In an embodiment, the projectile body 100 is positioned to extend through the lumen 430 defined by the inner surface 426 of the case wall. In an embodiment, the projectile body 100 is positioned so that a plane P defined by the forward edge 428 of the case wall 424 passes through the polymer band 46 disposed in the circumferential groove 44 defined by the barrel engaging portion 104 of the projectile body 100. In an embodiment, an upper portion of the case wall 424 is swaged or crimped inwardly to form a seal between the case wall 424 and the projectile 420 for closing the opening 434 and preventing fluid communication between the propellant charge 436 in the cavity 432 and an atmosphere outside of the ammunition cartridge 400.

Referring to FIG. 24, the forwardmost polymer band has a convex exterior surface 450 that is projecting radially outward from the outer surface 86 of the projectile body 100. The upper lip 52 may be crimped into the forwardmost polymer band 46.2 providing an enhanced barrier to moisture. A corner 52.2 of the lip is illustrated as embedded into the band, deforming the band. The polymer bands rearward of the forwardmost band may also have a convex exterior surface. The casing may be swaged thereto deforming the bands so that the bands so that they are flush against the casing and flush with respect to the outer surface of the projectile body. Such features providing enhanced sealing of the case to the projectile for moisture protection. Such concavity may extend a few thousandths or more radially outward from the barrel engaging portion surface 322.

The forwardmost band 46.2 on the barrel engaging portion, or the ogival band 46.7, may have a color 350 that identifies a particular characteristic of the projectile and/or cartridge, such as projectile weight, shape, or core presence, with different colors used for different characteristics. The other bands, rearward of the forwardmost band 46.2 may also have colors 351 providing information regarding the projectile. Of course, such information indicating bands not visible in a cartridge are of use prior to loading in a case and subsequent to firing.

The following United States patents are hereby incorporated by reference herein: U.S. Pat. Nos. 3,881,421, 4,044,685, 4,655,140, 4,685,397, 5,127,332, 5,259,320, U.S. Pat. No. 535,101, 6,070,532, and 8,186,277.

The following United States patents and publications are hereby incorporated by reference herein: U.S. Pat. Nos. 1,080,974, 1,135,357, 1,493,614, 1,328,334, 1,967,416, U.S. Pat. No. 375,158, U.S. Pat. Nos. 5,454,325, 6,317,946, 7,380,502, US 2017/0108320, US 2007/0131130, and 2005/0126422.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A low caliber ammunition cartridge, comprising:

a case comprising a base portion and a case wall extending forward from the base portion to a forward edge of the case wall defining a case cavity and a forward case mouth propellant disposed inside the case cavity for producing a quantity of propellant gas;

a primer housing disposed in a hole defined by the base portion of the case, and a priming material disposed inside the primer housing for igniting the propellant;

a projectile secured in the mouth of the casing, the projectile comprising a unitary projectile body having a rearward tail portion, a forward nose portion, and a barrel engaging portion extending between and unitary with the nose portion and the tail portion, the barrel engaging portion including a monolithic portion, the monolithic portion having three circumferential grooves spaced intermediate the tail portion and the nose portion, each of the circumferential grooves has an undercut;

the projectile further comprising three overmolded polymer bands disposed in the three circumferential grooves, each of the three overmolded bands conforming to the shape of the respective groove.

2. The low caliber ammunition cartridge of claim 1 wherein at least one of the three overmolded bands has an outer convex surface that extends radially beyond the outer surface of the projectile body providing a sealing surface with an interior surface of the case wall.

3. A low caliber ammunition cartridge, comprising:

a case comprising a base portion and a case wall extending forward from the base portion to a forward edge of the case wall defining a case cavity and a forward case mouth propellant disposed inside the case cavity for producing a quantity of propellant gas;

a primer housing disposed in a hole defined by the base portion of the case, and a priming material disposed inside the primer housing for igniting the propellant;

a projectile secured in the mouth of the casing, the projectile comprising a unitary projectile body having a rearward tail portion, a forward nose portion, and a barrel engaging portion extending between and unitary with the nose portion and the tail portion, the barrel engaging portion having a monolithic portion and a plurality of circumferential grooves positioned on the monolithic portion;

the projectile further comprising a plurality of overmolded polymer bands disposed respectively in each of the plurality of circumferential grooves, each band conforming to the shape of the respective groove and secured therein;

an upper portion of the case wall is swaged or crimped inwardly to form a seal between the case wall and the projectile for closing the opening and preventing communication between the propellant in the cavity and an atmosphere outside of the ammunition cartridge; and the forward edge of the case wall is at one of the plurality of overmolded bands.

4. The low caliber ammunition cartridge of claim 3, wherein each band is secured within the respective groove at least partially by said band being adhered to the respective groove wall surface by overmolding of each said band into the respective groove.

5. The low caliber ammunition cartridge of claim 3 wherein at least one of the plurality of bands has an exterior convex surface that provides a sealing surface with an interior wall surface of the case wall of the casing, the exterior surface having a diameter greater than the greatest diameter of the barrel engaging portion of the projectile body.

6. The low caliber ammunition cartridge of claim 3, wherein there are three overmolded bands engaged with the interior surface of the case wall.

7. The low caliber ammunition cartridge of claim 3, wherein each of the plurality of grooves has a curved interior surface whereby in a cross section taken along the axis of the projectile body, the juncture between the groove surface and the overmolded ring is C-shaped.

8. The low caliber ammunition cartridge of claim 3, wherein each overmolded band has a width at the outer surface of respective band and each said band has a greater width inward of said outer width thereby securing the band in the respective groove.

9. The low caliber ammunition cartridge of claim 3, wherein the plurality of bands comprise at least two different colors and the colors correlate to a characteristic of the projectile or cartridge.

10. The low caliber ammunition cartridge of claim 3, wherein the color of the forwardmost band is selected from a plurality of colors and the color correlates with a characteristic of the projectile or cartridge.

11. The low caliber ammunition cartridge of claim 3, wherein the projectile body further has a rearward aperture extending axially into a rearwardly face of the tail portion, and the projectile further comprises a plug overmolded in the aperture.

12. A low caliber ammunition cartridge, comprising:

a case comprising a base portion and a case wall extending forward from the base portion to a forward edge of the case wall defining a case cavity and a forward case mouth propellant disposed inside the case cavity for producing a quantity of propellant gas;

a primer housing disposed in a hole defined by the base portion of the case, and a priming material disposed inside the primer housing for igniting the propellant;

a projectile secured in the mouth of the casing, the projectile comprising a unitary projectile body having an exterior surface, a rearward tail portion, a forward nose portion with a nose tip, and a barrel engaging portion extending between and unitary with the nose portion and the tail portion, the body having an interior surface defining a central cavity extending rearwardly from the nose tip, whereby a projectile wall is defined between the interior surface and the exterior surface, the projectile body having a circumferential groove cut inwardly into the exterior surface of the projectile body, the interior surface not having any structure thereon reflective of the circumferential groove;

an overmolded polymer band in the groove, the band having an outer surface that is flush with and continuous with respect to the exterior surface of the projectile body.

13. The low caliber ammunition cartridge of claim 12 wherein the forward nose portion has an ogive portion and the circumferential groove is positioned on said ogive portion.

14. The low caliber ammunition cartridge of claim 12 further comprising a plurality of circumferential grooves rearward of the cavity, each of the plurality of circumferential grooves having an overmolded band therein with an outer surface, said outer surface flush with the exterior surface of the projectile body.

15. The low caliber ammunition cartridge of claim 12 wherein there is not a gap between the circumferential band and the projectile body.

16. The low caliber ammunition of claim 12 wherein the projectile comprises a central axially extending cavity at the rearward face of the tail portion, and wherein there is an overmolded plug in said central aperture.

* * * * *